US011555499B2

(12) United States Patent
Blad

(10) Patent No.: US 11,555,499 B2
(45) Date of Patent: Jan. 17, 2023

(54) CENTRIFUGAL PUMP ASSEMBLY

(71) Applicant: GRUNDFOS HOLDING A/S, Bjerringbro (DK)

(72) Inventor: Thomas Blad, Bjerringbro (DK)

(73) Assignee: GRUNDFOS HOLDING A/S, Bjerringbro (DK)

( * ) Notice: Subject to any disclaimer, the term of this patent is extended or adjusted under 35 U.S.C. 154(b) by 504 days.

(21) Appl. No.: 16/492,755

(22) PCT Filed: Mar. 12, 2018

(86) PCT No.: PCT/EP2018/056078
§ 371 (c)(1),
(2) Date: Sep. 10, 2019

(87) PCT Pub. No.: WO2018/166967
PCT Pub. Date: Sep. 20, 2018

(65) Prior Publication Data

US 2020/0072223 A1 Mar. 5, 2020

(30) Foreign Application Priority Data

Mar. 14, 2017 (EP) ..... 17160831

(51) Int. Cl.
*F04D 15/00* (2006.01)
*F04D 13/06* (2006.01)
(Continued)

(52) U.S. Cl.
CPC ..... *F04D 15/0016* (2013.01); *F04D 1/00* (2013.01); *F04D 13/06* (2013.01);
(Continued)

(58) Field of Classification Search
CPC ..... F04D 15/0016; F04D 29/042; F04D 29/4293; F04D 15/0066; F04D 15/0022;
(Continued)

(56) References Cited

U.S. PATENT DOCUMENTS 1,955,549 A * 4/1934 Johnt ..... F04D 29/042 415/24
5,924,432 A * 7/1999 Thies ..... F04D 29/448 134/198

(Continued)

FOREIGN PATENT DOCUMENTS

CN 2418287 Y 2/2001
CN 1690443 A 11/2005

(Continued)

*Primary Examiner* — Peter J Bertheaud
(74) *Attorney, Agent, or Firm* — McGlew and Tuttle, P.C.

(57) ABSTRACT

A centrifugal pump assembly includes an electrical drive motor (4, 6), an impeller (14) which is driven by the electrical drive motor (4, 6) as well as with at least one valve element (18) which is directly or indirectly movable along a first movement path between at least two switching positions, by the electrical drive motor (4, 6). At least a part of the valve element (18) is additionally movable along a second movement path which is different to the first movement path, between a released position, in which the valve element is distanced to at least one contact surface and a bearing position, in which the valve element bears on the at least one contact surface.

4 Claims, 32 Drawing Sheets

(51) Int. Cl.

| | |
|---|---|
| ***F04D 29/42*** | (2006.01) |
| ***F24D 3/10*** | (2006.01) |
| ***F04D 29/48*** | (2006.01) |
| ***F04D 1/00*** | (2006.01) |

(52) U.S. Cl.
CPC ..... *F04D 13/0606* (2013.01); *F04D 15/0005* (2013.01); *F04D 15/0022* (2013.01); *F04D 15/0038* (2013.01); *F04D 15/0066* (2013.01); *F04D 29/4293* (2013.01); *F04D 29/486* (2013.01); *F24D 3/105* (2013.01); *F24D 2220/0207* (2013.01)

(58) Field of Classification Search
CPC ..... F04D 13/06; F04D 15/0005; F04D 1/00; F04D 13/0606; F04D 29/486; F04D 15/0038; F24D 3/105; F24D 2220/0207
See application file for complete search history.

(56) References Cited

U.S. PATENT DOCUMENTS

| | | | |
|---|---|---|---|
| 2015/0167673 | A1 | 6/2015 | Saccoccio et al. |
| 2016/0258340 | A1 | 9/2016 | Klippert et al. |

FOREIGN PATENT DOCUMENTS

| | | | |
|---|---|---|---|
| CN | 104024647 | A | 9/2014 |
| JP | H10141287 | A | 5/1998 |
| WO | 2015/110608 | A1 | 7/2015 |
| WO | 2016202723 | A1 | 12/2016 |

* cited by examiner

CENTRIFUGAL PUMP ASSEMBLY

CROSS REFERENCE TO RELATED APPLICATIONS

This application is a United States National Phase Application of International Application PCT/EP2018/056078, filed Mar. 12, 2018, and claims the benefit of priority under 35 U.S.C. § 119 of European Application 17 160 831.8, filed Mar. 14, 2017, the entire contents of which are incorporated herein by reference.

TECHNICAL FIELD

The invention relates to a centrifugal pump assembly with an electrical drive motor, with an impeller which is driven by this, as well as with a valve element.

TECHNICAL BACKGROUND

Centrifugal pump assemblies which comprise an integrated valve device which for example can be moved between two switching positions by way of different rotation directions of the drive motor and thus flows in the inside of a pump casing which are directed in different directions, are known. These valve devices can switch very simply between two possible flow paths at the outlet side of the pump assembly. In contrast, a switch-over between two flow paths at the suction side of a pump assembly is only possible via a complicated mechanism.

SUMMARY

With regard to this problem, it is an object of the invention to improve a centrifugal pump assembly with a valve element which is movable between at least two switching positions, to the extent that on the one hand a simpler construction of the valve device and on the other hand a reliable movement of the valve element is simultaneously ensured.

The centrifugal pump assembly according to the invention comprises an electrical drive motor as well as at least one impeller which can be rotatingly driven by this electrical drive motor. The electrical drive motor is preferably configured as a wet-running motor, i.e., as a motor with a can between the stator and the rotor. Concerning such a motor, the rotor rotates in the fluid to be delivered. The centrifugal pump assembly, particularly when using a wet-running electrical motor, can be provided for example for application in a heating facility or air-conditioning facility. It can be applied there as a circulation pump assembly.

The centrifugal pump assembly according to the invention moreover comprises at least one valve element which can be directly or indirectly moved along a first movement path between at least two switching positions by the electrical motor which drives the impeller. A direct movement can be achieved for example by way of a suitable, releasable coupling, in particular by a magnetic or mechanical coupling, between the rotor or impeller of the drive motor and the valve element. An indirect movement can be created for example via the fluid which is delivered by the impeller, by way of the fluid flow and/or the pressure of the fluid acting upon the valve element such that this element can be moved. A movement along a first movement path between at least two switching positions is accomplished in this manner. Here, the movement path can run linearly or arcuately or can be a rotation movement.

According to the invention, the at least one valve element is configured and arranged such that additionally to the movability along the first movement path, at least a part or section of the valve element is movable along a second movement path which is different to the first movement path. I.e., a movement of the valve element in at least two different directions which are preferably angled to one another is possible. The valve element or a part of the valve element is movable along the second movement path between a released position, in which it is released from at least one contact surface (bearing surface) and in particular is distanced to this surface, and a bearing position (contacting position), in which it is pressed onto the at least one contact surface. In the released position, the valve element is thereby preferably movable, in particular along a first movement path between the at least two switching positions. In the released position, the valve element can thereby be distanced to the contact surface or however can be situated such that it can easily slide along the contact surface. In contrast, in the second bearing position, the valve element bears on the contact surface preferably in such a firm manner that it is held in a previously assumed switching position, i.e. the movement along the first movement path is prevented. In the bearing position, the valve element is pressed against the contact surface such that the friction between the valve element and the contact surface is greater than in the released position. In this condition, this permits the centrifugal pump assembly to be operated in the conventional manner by way of the operation of the electrical drive motor and in particular permits the closed-loop control (regulation) of the speed, without the valve element leaving its previously assumed switching position. In order to be able to move the valve element into another switching position, it is moved prior to this along the second movement path into the released position, so that then, driven by the drive motor, it can move into another switching position. The movement along the second movement path is preferably likewise initiated directly or indirectly by the electrical drive motor. This movement in particular can be effected in a pressure-dependent manner, so that the valve element is pressed into the bearing position on exceeding a predefined outlet pressure of the centrifugal pump assembly. A movement of the valve element between the switching positions is possible if the centrifugal pump assembly is operated at a lower pressure or differential pressure.

According to the invention, either the valve element as a whole can be movable along the second movement path or only a section of the valve element, for example an elastically deformable section of the valve element such as an elastic seal for example, can be movable along the second movement path. When, in the present description, one speaks of a movability of the valve element along the second movement path, then this is thereby to expressly always include an embodiment concerning which only a part or a section of the valve element is movable along the second movement path.

The at least one valve element is preferably mechanically and/or hydraulically coupled to the drive motor in a manner such that it is movable along the first and/or the second movement path by way of the drive motor. The movement along the first movement path can thereby be effected for example by a hydraulic flow which is caused by the impeller, by way of this flow acting upon the valve element which is to say entraining this in the flow direction by way of friction. Alternatively, a mechanical or magnetic coupling, in particular a frictional coupling can also be provided. Such a coupling can further preferably be configured such that it can be disengaged in a pressure-dependent manner, i.e. it releases itself on reaching a defined outlet pressure of the pump assembly, so that the drive motor can continue to rotate in an unhindered manner without moving the valve element further. The valve element can be moved along the second movement path, for example in a purely pressure-dependent manner, by way of a defined outlet pressure of the fluid delivered by the impeller, when this is reached, acting upon the valve element such that it is pressed against the contact surface and is held there preferably with a friction fit and/or positive fit, so that in particular a flow or other coupling cannot move the valve element further between the switching positions. The different flow speed or pressures at the outlet side of the impeller can be adjusted or set via a control device which activates the drive motor. Here, the control device is preferably configured such that it can adjust in particular the speed and further preferably also the acceleration courses of the drive motor.

The second movement path preferably extends transversely to the first movement path or transversely to a plane, in which the second movement path extends or runs. In particular, the planes, in which the movement paths run, are aligned normally to one another. For example, the second movement path can be a rotation movement about a rotation axis and the second movement path can be a linear movement along this rotation axis.

The rotation axis, about which the valve element is rotatable along the first movement path, preferably extends parallel or is aligned to the rotation axis of the impeller. This permits a particularly simple coupling between the drive motor and the impeller on the one hand and the valve element on the other hand.

The valve element is usefully rotatably mounted in a manner such that in the released position, it is rotatable about a mounting and in particular about a central mounting, between the at least two switching positions and preferably in the second, bearing position, is held on the contact surface in a rotationally fixed manner. Here, the central mounting is preferably configured such that in the released position, the valve element preferably bears essentially only in the mounting, so that it can be particularly easily rotated. Additionally, the valve element can possibly yet bear on a restoring element which forces it into the released position. The mounting is preferably permanently lubricated or is lubricated by the fluid to be delivered, so that a particularly easy motion of the mounting is achieved. In the bearing position, the valve element with the contact surface forms a non-positive and/or positive coupling which prevents a rotation and therefore holds the valve element in the assumed switching position.

The second movement path is preferably a straight line and further preferably a straight line which extends parallel to or along the rotation axis of the at least one valve element. The valve element can therefore be rotatingly mounted in its central region, wherein the mounting is preferably configured such that it permits a certain linear movement along the rotation axis, in order to permit the movement along the second movement path.

The at least one contact surface is preferably at least one sealing surface. The sealing surface can be formed for example by a valve seat which surrounds a valve opening of a flow path. A sealing of the valve opening is simultaneously achieved by the valve element bearing on this sealing surface. The described friction fit for preventing the movement of the valve element can additionally be achieved by way of this bearing contact. Alternatively or additionally, a sealing surface can also be arranged such that in its bearing position, the valve element seals the suction side with respect to the delivery side of the centrifugal pump assembly when the valve element is situated between the suction side and the delivery side.

Further preferably, the at least one valve element comprises a pressure surface which is in connection with a delivery side of the impeller in a manner such that a pressure which prevails at the delivery side acts upon the pressure surface and thereby produces a pressing force which acts upon the valve element, wherein the pressure surface is situated such this pressing force is directed at least partly along the second movement path of the valve element and in particular along the second movement path towards the bearing position. Given an adequately high pressure at the delivery side of the impeller, i.e. in a delivery chamber of the pump casing, said pump casing surrounding the impeller, such a high pressure is produced that this displaces the valve element or a section of the valve element out of the released position into the bearing position and presses it against the contact surface, in order to non-positively and/or frictionally hold the valve element there and/or to ensure an adequate sealing given the bearing contact on at least one sealing surface.

According to a further preferred embodiment, the valve element is coupled to at least one restoring element, in particular a restoring spring which exerts a restoring force along the second movement path, in particular towards the released position, upon the valve element. The restoring element ensures that when the pump assembly is taken out of operation, the valve element is moved into an initial position which preferably corresponds to the released position. In this released position, the valve element is then freely movable preferably between the switching positions as described above. If the drive motor is driven in this condition, it is possible to move the valve element between the switching positions by way of a suitable activation of the drive motor. A force which overcomes the restoring force, in order to move the valve element into the bearing position can be exerted upon the valve element, so as to indeed bring the valve element into the bearing position. This can be effected for example by way of a pressure being built up at the outlet side of the impeller as described beforehand, said pressure producing a pressing force on a pressure surface of the valve element, wherein this pressing force is directed oppositely to the described restoring force. The valve element is moved into the bearing position if the pressing force is greater than the restoring force.

According to a further possible embodiment, the function of the restoring element can be achieved by way of an elastic deformability of a section of the valve element which is movable along the second movement path. The restoring function is assumed by elastic restoring forces.

According to a further preferred embodiment, the centrifugal pump assembly can comprise a force generating means which exerts a force upon the valve element in the direction of one of the at least two switching positions, wherein the force is preferably a spring force, a magnetic force and/or the gravity force. The switching position, in whose direction the force which is produced by the force generating means is directed, preferably forms an initial position or idle position. The force generating means is preferably configured and arranged such that given a standstill of the centrifugal pump assembly, it forces the valve element into this initial position or a predefined switching position. The valve element can then be moved out of this into another switching position by way of a suitable activation of the drive motor. However, if the movement of the valve element along the second movement path is effected first of all and the valve element therefore comes to bear on the contact surface, then the valve element can also be held in that switching position which corresponds to the initial position, even on operation of the centrifugal pump assembly. This can be effected for example by way of a very quick acceleration of the drive motor, by which means such a pressure which can impinge the valve element at a pressure surface and can press it against the contact surface is formed directly at the outlet side of the impeller.

Particularly preferably, the coupling between the drive motor and the valve element is configured in a hydraulic manner, wherein the at least one valve element is preferably configured in a manner such that it is movable along the first movement path by a fluid flow which is brought into motion by the impeller. This fluid flow is particularly preferably a rotating fluid flow in the outlet region of the impeller, said fluid flow surrounding the impeller when it is rotated. This flow can act upon the valve element for example by way of friction and entrain or co-move this, particularly if the valve element is configured such that it is rotatable between the switching positions about a rotation axis which corresponds to the rotation axis of the impeller. This hydraulic coupling has the advantage that after reaching the desired switching position, the flow in the pump casing can continue to flow in an uninhibited manner, whilst the valve is held in the reached switching position by a stop and/or bearing contact on the contact surface. In this condition, the flow at the surface of the valve element preferably only causes a friction which corresponds to the normal friction in the inside of the pump casing, so that essentially no additional loss of performance arises in the centrifugal pump assembly due to this switching functionality.

According to a special embodiment of the invention, the drive motor is configured or can be activated by a control device such that it can be driven in two different rotation directions. The impeller is moreover preferably configured such that it produces differently directed fluid flows depending on its rotation direction, by way of which flows the at least one valve element is movable along the first movement path in opposite directions. The valve element can therefore be moved to and fro between the at least two switching positions by way of the reversal of the rotation direction of the drive motor and thus of the impeller. If, as described above, a force generating means for producing a forces which move the valve element back into an initial position is provided, then one can make do without this reversal of the rotation direction of the drive motor, since the return movement of the valve element is then effected by the force generating means, whilst the movement out of the initial position can be effected via the drive motor in the described manner.

Particularly preferably, the drive motor comprises a control device which activates the drive motor in a manner such that the speed and/or the acceleration and/or the rotation direction of the drive motor is changeable in a targeted manner, in order to achieve the procedures which have been described above.

According to a further preferred embodiment of the invention, the valve element is arranged and configured such that it is movable along the first movement path by way of a flow which is produced by the impeller and is movable along the second movement path by way of a fluid pressure which is produced at the outlet side by the impeller. The drive motor preferably comprises a control device which is configured such that the drive motor can be started up with a first acceleration course, at which the pressure builds up more rapidly than the flow, and with a second acceleration course, at which the flow builds up more rapidly than the pressure. Here, the first acceleration course preferably corresponds to a greater acceleration than the second acceleration course. If such a pressure as to permit the valve element to be able to be pressed onto a contact surface by way of the pressure before an adequate flow capable of moving the valve element in the described manner builds up is rapidly reached, then the valve element can consequently be held in that switching position which corresponds to the initial position. If in contrast the acceleration takes its course more slowly, then no such high pressure to the extent that the valve element is moved along the second movement path into the bearing position is reached, and a flow which can move the valve element into the other switching position in the described manner can firstly form. The valve element can therefore be moved into the desired switching position in a targeted manner and held in this for the further operation of the pump assembly solely by way of activating (controlling) the drive motor. The pressure, at which the valve element comes into bearing contact with the contact surface, here is preferably selected such that it corresponds to a pressure which is smaller than the usual operating pressure of the centrifugal pump assembly, so that the normal operation of the centrifugal pump assembly is not compromised after reaching the switching position.

According to a further preferred embodiment, for its movement along the first path, the at least one valve element can be coupled to the impeller or to a shaft of the drive motor which drives the impeller or directly to the rotor of the drive motor, via a coupling which is preferably releasable in a pressure-dependent and/or speed-dependent and/or rotation-direction-dependent manner. This can be a mechanical coupling which transmits the rotation movement of the drive motor onto the valve element, in order to move this between the switching positions. The coupling can be configured such that it disengages on reaching a certain fluid pressure at the outlet side of the impeller. Moreover, it can be configured such that it disengages at a certain speed, for example by way of a lubrication film forming between the coupling parts, said lubrication film essentially lifting the friction fit, so that the coupling parts can slide on one another in the manner of a plain bearing. The lubrication film can be built up for example by the fluid which is delivered by the impeller. The fluid is particularly preferably water. A coupling which is dependent on the rotation direction is also possible, and this for example acts in only one direction, for example in the manner of a pawl or ratchet, whereas the coupling elements slide on one another in the opposite rotation direction. Thus e.g. a rotation direction of the drive motor which preferably does not correspond to the normal rotation direction of the impeller can be used to move the valve element into a desired switching position, whereas the coupling does not act in the other rotation direction which then preferably corresponds to the normal operating rotation direction, so that the valve element remains in the reached switching position. Such a coupling can particularly preferably be used in combination with the force generating means which are described above, for producing a force which moves the valve element back again into an initial position. A hydraulic coupling is moreover possible between the impeller and the drive motor, as has been described beforehand.

According to a further preferred embodiment, the at least one valve element can be configured and arranged in a manner such that in a pump casing which surrounds the impeller, it separates a suction chamber which is in connection with a suction side of the impeller from a delivery chamber which is in connection with the delivery side of the impeller. Further preferably, here the valve element can annularly surround a suction port of the impeller. The arrangement of the valve element between the suction side and delivery side has the advantage that the differential pressure between the suction side and delivery side can be used to move the valve element along the second movement path. The delivery-side pressure acts upon one side of the valve element, whilst the suction-side pressure acts upon the opposite side. Moreover, it is possible for fluid flows to engage on one or both sides of the valve element, i.e. at the delivery side and/or suction side, in order to move the valve element along the first movement path.

Further preferably, the at least one valve element is configured and arranged in a manner such that in a pump casing which surrounds the impeller, it separates a suction chamber which is in connection with the suction side of the impeller, from a delivery chamber which is in connection with a delivery side of the impeller, wherein in the delivery chamber, a flow which is produced by the impeller acts upon the valve element for its moment along the first movement path, and the suction chamber is configured in a manner such that the flow which prevails there exerts no force upon the valve element in the direction of the first movement path. The flow which runs in the delivery chamber, preferably the flow which runs in a manner surrounding the impeller can drive or move the valve element in a targeted manner, in order to move it between the switching positions. Lower or no forces act counter to this at the suction side. However, it is alternatively also possible to configuration the suction-side flow paths such that the flow which prevails there exerts a suitable force upon the valve element for its movement.

According to a further preferred embodiment of the invention, the centrifugal pump assembly comprises at least two alternative flow paths, wherein the at least one valve element is arranged in these flow paths in a manner such that these flow paths are opened to a different extent in the at least two switching positions The valve element can therefore assume for example the function of a switch-over valve by way of it reciprocally opening the two flow paths. I.e. in a first switching position, the first flow path is closed and the second flow path is opened, whilst in a second switching position, the first flow path is opened and the second flow path is closed. It is also possible to configuration the valve element as a mixing valve, in which the flows from the two flow paths are mixed in changeable ratios. With such a configuration, it is preferable for the valve element to be able to assume more than two switching positions, in which the flow paths are open to a different extent. Here, the valve element is preferably configured such that given its displacement, it closes a flow path by a certain amount, whilst the other flow path is simultaneously opened by the same amount.

The described flow paths are preferably situated at the suction side of the impeller, i.e. if the valve element for example acts as a switch-over valve in the described manner, then the impeller can suck fluid from one of the two flow paths depending on the position of the switching element. The switch-over valve can be applied for example in a heating facility, in order to lead the circuit of the fluid delivered by the centrifugal pump assembly selectively through a heat exchanger for producing serve water and through a heating circuit. In particular, if the valve element operates as a mixing valve, it is however also possible for the two flow paths to be situated at the delivery side of the impeller, wherein one of the flow paths then before the mixing valve preferably runs through a heat source or a heat exchanger, in order to adjust the temperature of the fluid, whereas the other flow path runs directly to the mixing valve. A temperature-adjusted flow can therefore be mixed in the mixing valve with flow which is not adjusted in temperature.

The invention is hereinafter described by way of example and by way of the attached figures. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF PREFERRED EMBODIMENTS

Figure 1:
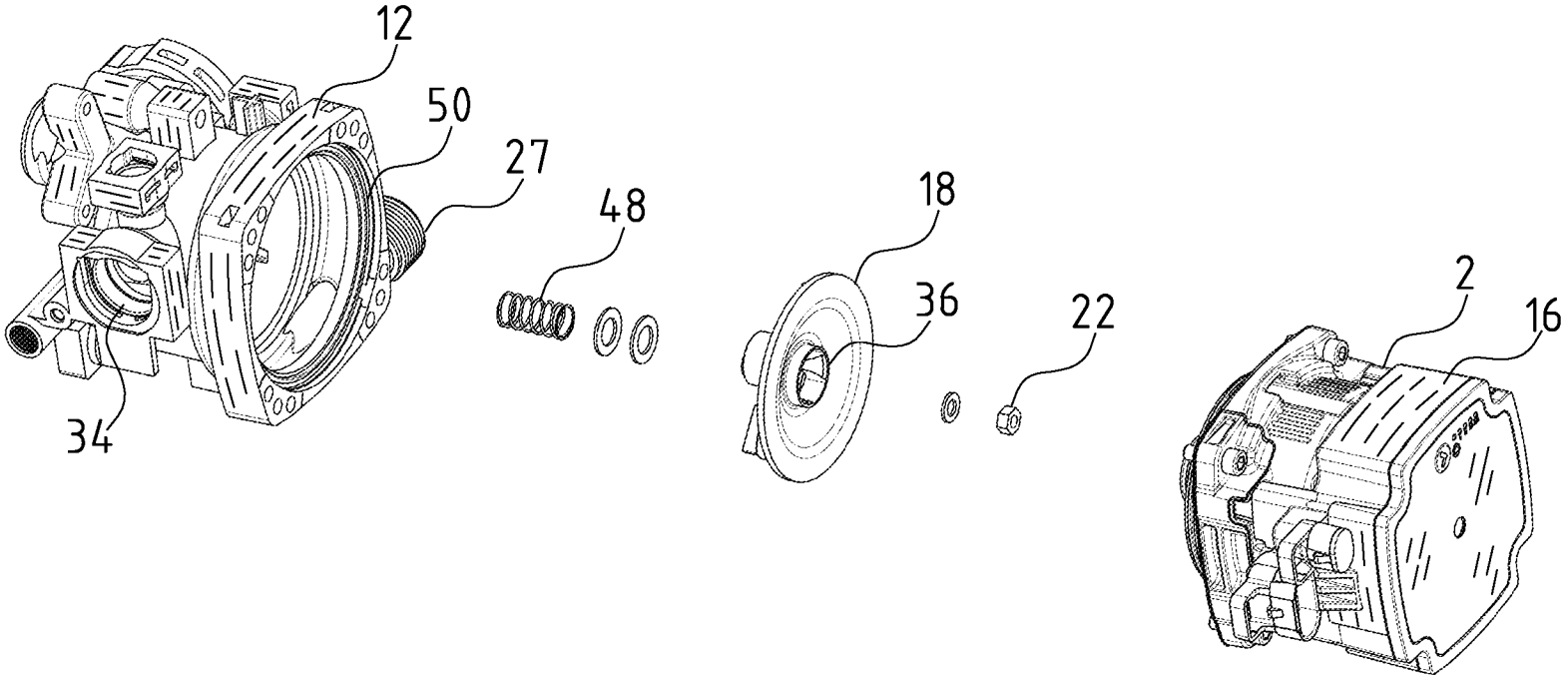
FIG. 1 is an exploded view of a centrifugal pump assembly according to a first embodiment of the invention.
Figure 3:
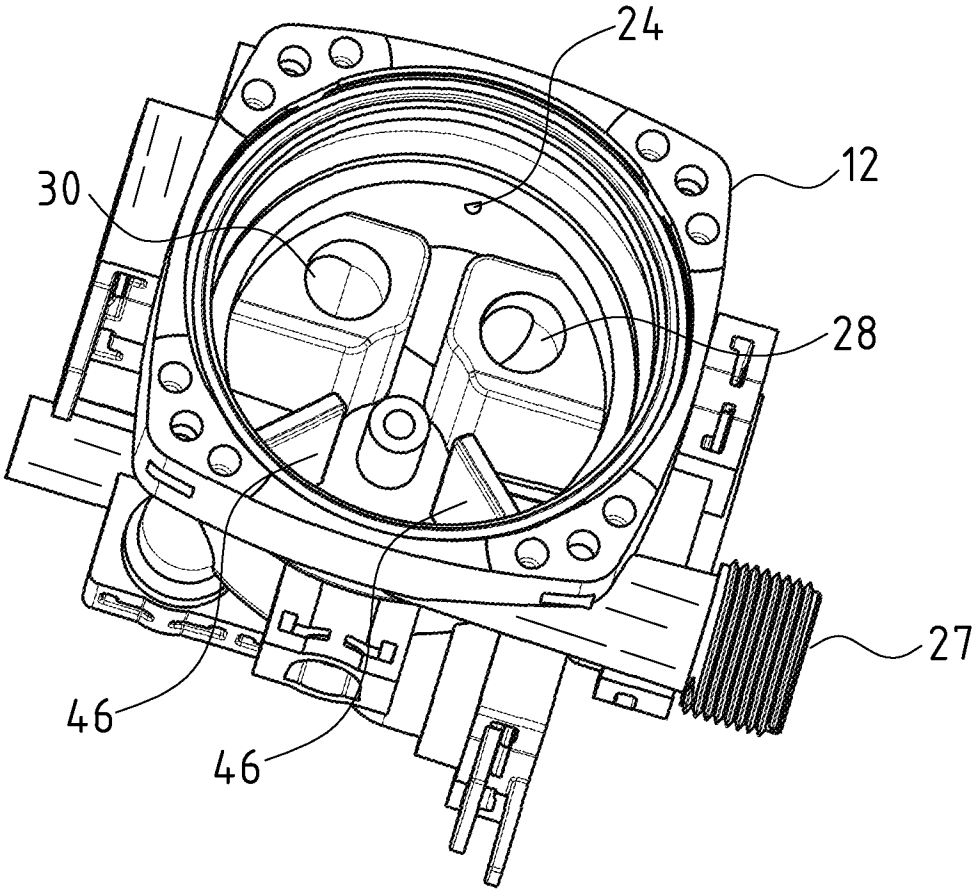
FIG. 3 is a perspective view of the pump casing of the centrifugal pump assembly according to FIG. 1 in the opened condition.
Figure 2:
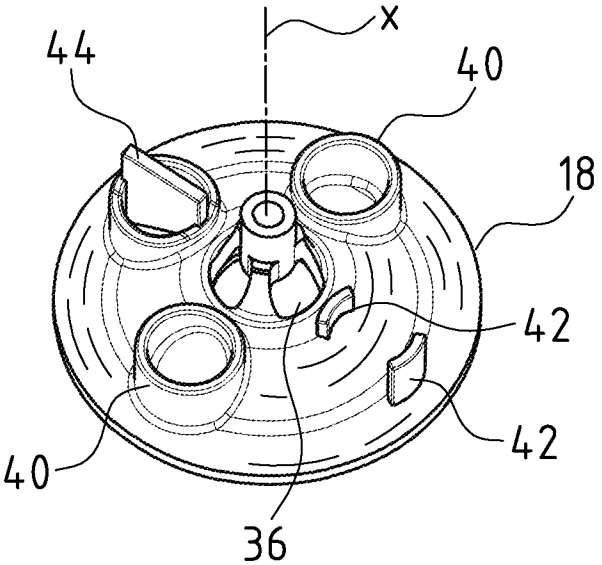
FIG. 2 is a perspective view of the lower side of the valve element of the centrifugal pump assembly according to FIG. 1.
Figure 4:
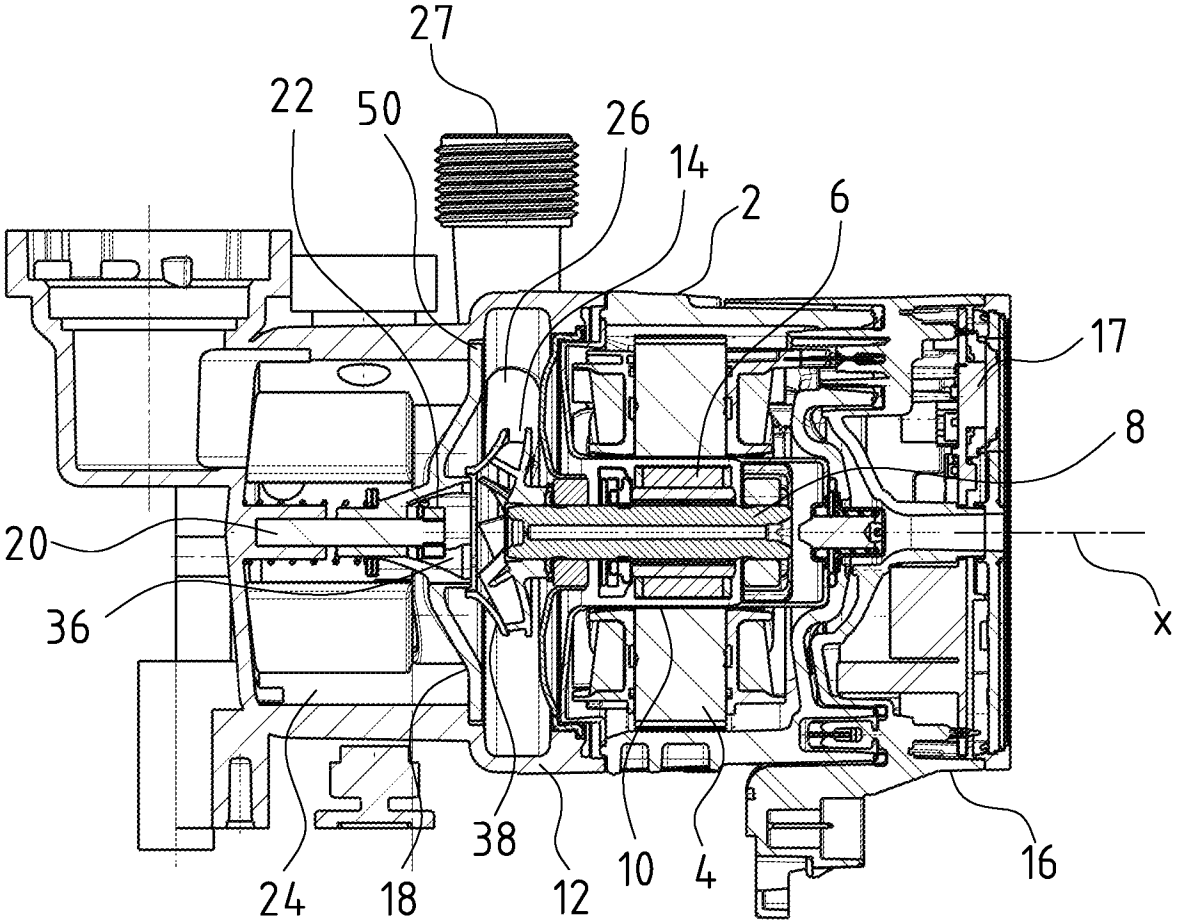
FIG. 4 is a sectional view of the centrifugal pump assembly according to FIG. 1.

Referring to the drawings, the embodiment examples of the centrifugal pump assembly according to the invention which are described in the following description relate to applications in heating systems and/or air conditioning systems, in which a fluid heat transfer medium, in particular water is circulated by the centrifugal pump assembly.

The centrifugal pump assembly according to the first embodiment of the invention comprises a motor housing 2, in which an electrical drive motor is arranged. This in the known manner comprises a stator 4 as well as a rotor 6 which is arranged on a rotor shaft 8. The rotor 6 rotates in a rotor space which is separated from the stator space, in which the stator 4 is arranged, by way of a can or a canned pot 10. This means that here it is the case of a wet-running electrical drive motor. The motor casing 2 is connected to a pump casing 12 at an axial end, in which pump casing an impeller 14 which is connected to the rotor shaft 8 in a rotationally fixed manner rotates.

An electronics housing 16 which contains control electronics or a control device for the activation of the electrical drive motor in the pump casing 2 is arranged at the axial end of the motor casing 2 which is opposite to the pump casing 12. The electronics casing 16 could also be arranged at another side of the pump casing 2 in a corresponding manner.

A movable valve element 18 is moreover arranged in the pump casing 12. This valve element 18 is rotatably mounted on a pivot 20 in the inside of the pump casing 12, and specifically such that the rotation axis of the valve element 18 is aligned with the rotation axis X of the impeller 14. The pivot 20 is fixed to the base of the pump casing 12 in a rotationally fixed manner. The valve element 18 is not only rotatable about the pivot 20 but is movable in the longitudinal direction X by a certain amount. This linear movability is limited in one direction by way of the pump casing 12, upon which the valve element 18 abuts with its outer periphery. In the opposite direction, the movablility is limited by the nut 22, with which the valve element 18 is fastened on the pivot 20. It is to be understood that a different axial fastening of the valve element 18 to the pivot 20 could also be selected instead of the nut 22.

In the pump casing 12, the valve element 18 separates a suction chamber 24 from a delivery chamber 26. The impeller 14 rotates in the delivery chamber 26. The delivery chamber 26 is connected to the delivery connection or delivery branch (delivery pipe connection) 28 of the centrifugal pump assembly which forms the outlet of the centrifugal pump assembly. Two suction-side inlets 28 and 30, of which the inlet 28 is connected to a first suction branch 32 and the inlet 30 is connected to the second suction branch 34 of the pump casing 12 run out into the suction chamber 24.

Figure 5:
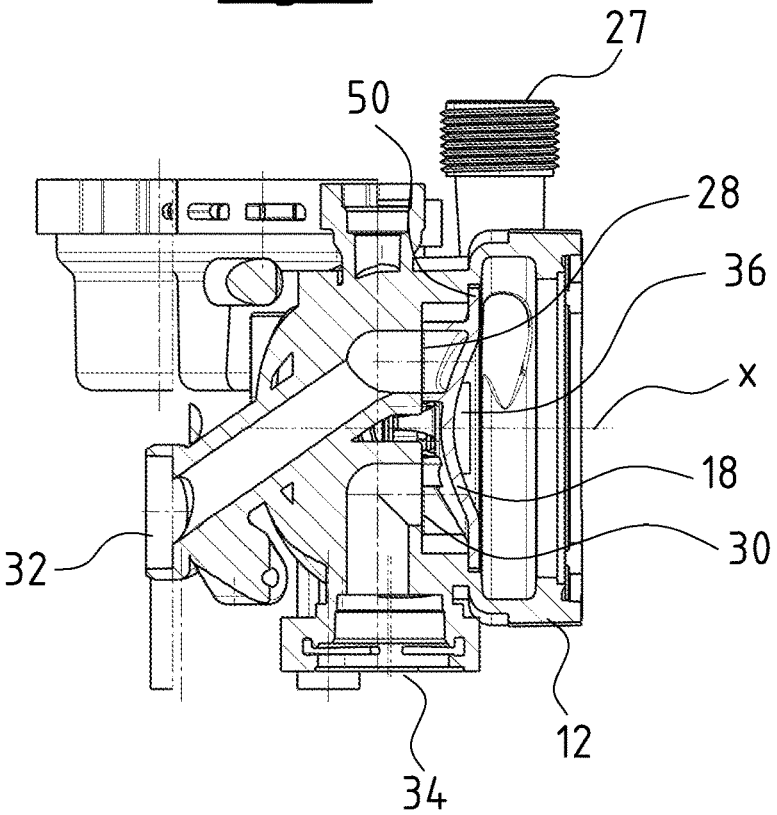
FIG. 5 is a sectional view of the pump casing of the centrifugal pump assembly according to FIG. 4 with the valve element in a first switching position.
Figure 6:
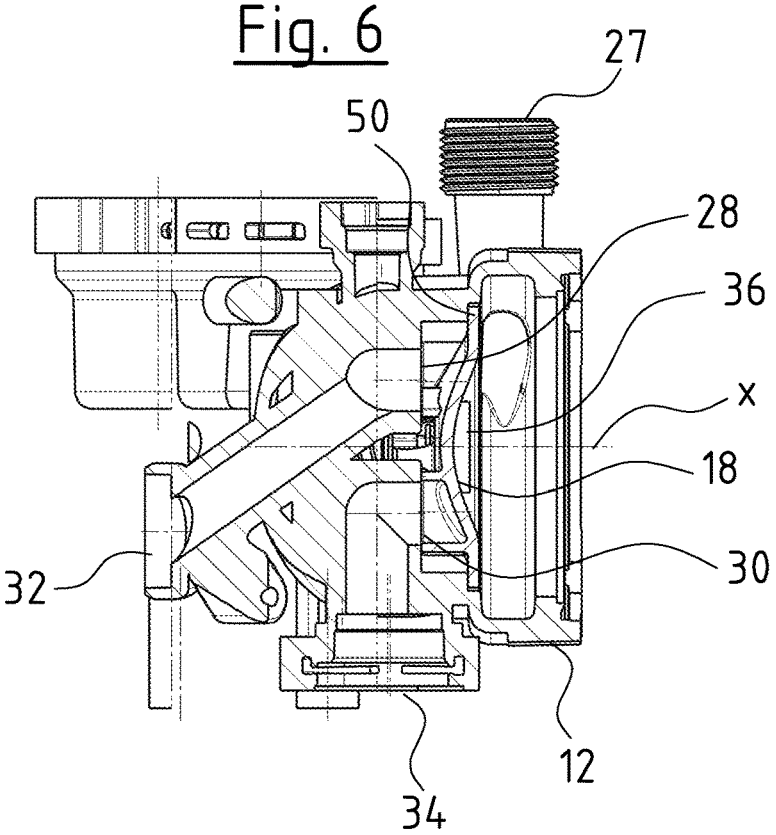
FIG. 6 is a sectional view according to FIG. 5 with the valve element in a second switching position.

The valve element 18 is configured in a disc-like manner and simultaneously assumes the function of a common deflector plate which separates the suction chamber 24 from the delivery chamber 26. The valve element 18 comprises a central suction opening 26 which comprises a projecting peripheral collar which is engaged with the suction port 38 of the impeller 14 and is essentially in sealing bearing contact with the suction port 38. Facing the impeller 14, the valve element 18 is configured in an essentially smooth manner. The valve element at the side which is away from the impeller 14 comprises two annular sealing surfaces 40 which in this embodiment example are situated on closed, tubular pipe connections. The two annular sealing surfaces 40 are arranged on the sealing element 18 at two diametrically opposite positions with respect to the rotation axis X of this element, so that they can come to sealing bear on the base of the pump casing 12 in the peripheral region of the inlets 28 and 30, so as to close the inlets 28 and 30. Support elements 42 are arranged offset to the sealing surfaces 40 at an angular position of 90° and can likewise come to bear on the peripheral region of the inlets 28, 30, but are distanced to one another such that they do not then close the inlets 28, 30. The inlets 28 and 30 do not lie on the diameter line with respect to the rotation axis X, but on a radially offset straight line, so that on rotation of the valve element 18 about the rotation axis X into a first switching position, the inlet 38 is closed by a sealing surface 40 whilst the support elements 42 lie on the inlet 30 and open this. In a second switching position, the inlet 30 is closed by a sealing surface 40 whilst the support elements 42 bear in the peripheral region of the inlet 28 and open this. The first switching position, in which the inlet 38 is closed and the inlet 30 is opened is represented in FIG. 5. The second switching position, in which the inlet 30 is closed and the inlet 28 is opened is represented in FIG. 6. This means that one can switch between the two switching positions by way of a rotation of the valve element about the rotation axis X by 90°. The two switching positions are limited by a stop element 44 which alternately hits two stops 46 in the pump casing 12.

In an idle position, which is to say when the centrifugal pump assembly is not in operation, a spring 48 presses the valve element 18 into released position, in which the outer periphery of the valve element 18 does not sealingly bear on the pump casing 12 and the sealing surfaces 40 do not sealingly bear in the peripheral region of the inlets 28 and 30, so that the valve element 18 can rotate about the axis 20. If the drive motor is now brought into rotation by the control device 17 in the electronics housing 16, so that the impeller 14 rotates, then a peripheral flow which via the friction co-rotates the valve element 18 in its rotation direction is produced in the delivery chamber 26. The control device 17 is configured such that it can drive the drive motor selectively in two rotation directions. The valve element 18 can therefore likewise be moved in two rotation directions about the rotation axis X depending in the rotation direction of the impeller 14, via the flow which is brought into rotation by the impeller 14, since the flow in the peripheral region of the impeller 14 always runs in its rotation direction. The valve element 18 can therefore be rotated between the two switching positions which are limited by the stops 46.

If the impeller 14 rotates at a sufficient speed, then a pressure builds up in the delivery chamber 26 and this pressure produces a pressing force on the surface of the valve element 18 which surrounds the suction opening 36, said pressing force being opposite to the spring force of the spring 48, so that the valve element 18 is moved in the axial direction X against the spring force of the spring 48 such that it comes to sealingly bear at its outer periphery on an annular contact shoulder 50 on the pump casing 12. Depending on the switching position, one of the sealing surfaces 40 simultaneously comes to sealingly bear on the periphery of one of the inlets 28 and 30, so that one of the inlets 28, 30 is closed. The support elements 42 come to bear on the other inlet, so that this inlet remains open and a flow path from this inlet 28, 30 to the suction opening 36 and from there into the inside of the impeller 14 is given. A frictional contact between the valve element 18 and the pump casing 12 is simultaneously created by way of the bearing of the valve element 18 on the contact shoulder 50 and on the sealing surface 40 in the peripheral region of one of the inlets 28, 30. This frictional contact ensures that the valve element 18 is held in the reached switching position. This permits the drive motor to be briefly taken out of operation and to be brought into operation again in the opposite rotation direction without the valve element 18 being rotated. If the switching-off and restarting operation of the motor are effected rapidly enough, then the pressure in the delivery chamber 26 does not reduce to the extent that the valve element 18 can again move in the axial direction into its released position. This permits the impeller to always be driven in its preferred rotation direction, for which the blades are configured, on operation of the centrifugal pump assembly and to only use the opposite rotation direction for moving the valve element 18 in the opposite rotation direction.

Figure 7:
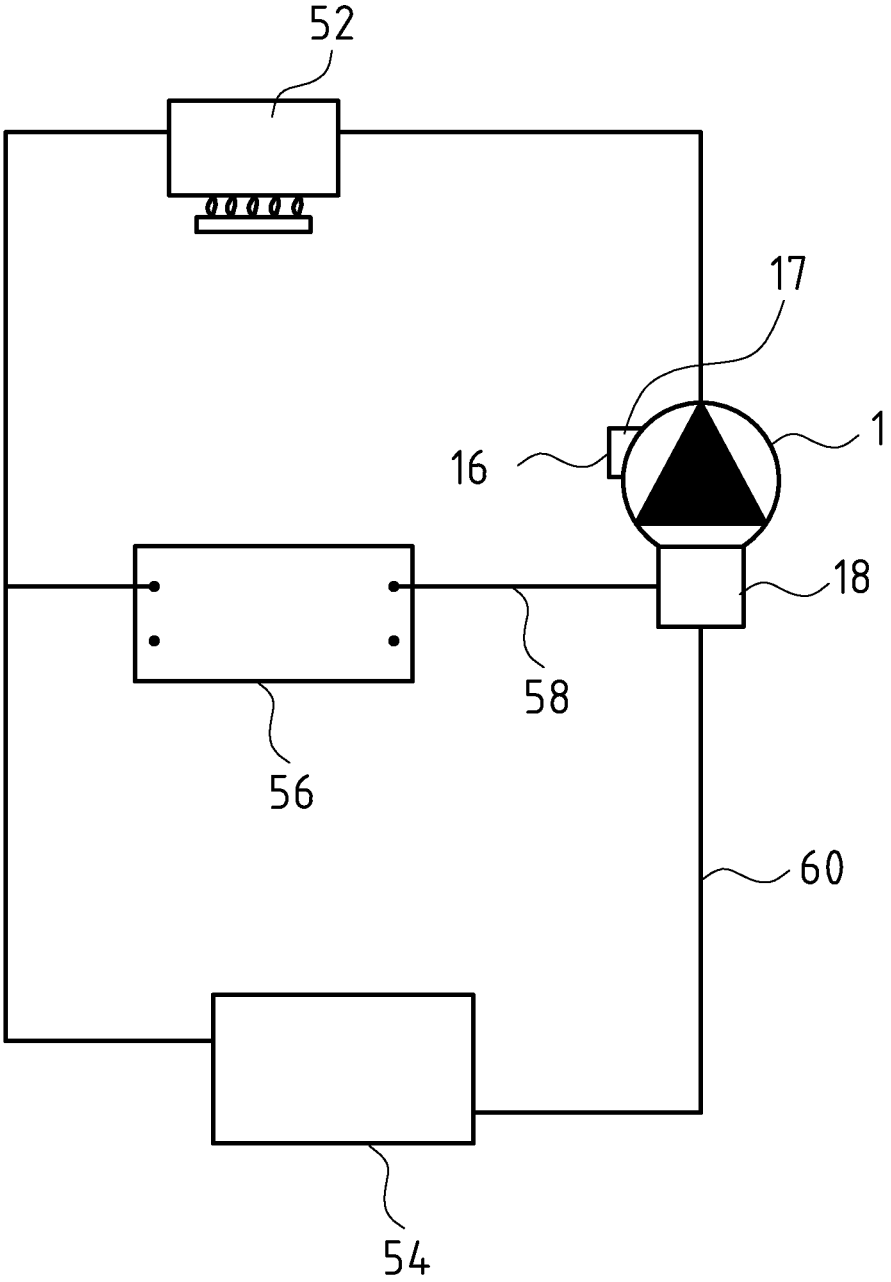
FIG. 7 is a schematic view showing the hydraulic construction with a heating facility with a centrifugal pump assembly according to FIGS. 1 to 6.

The described centrifugal pump assembly according to the first embodiment of the invention can be applied for example in a heating system as is shown in FIG. 7. Such a heating system is usually applied in apartments or houses and serves for heating the building or for the provision of heated service water. The heating facility comprises heat source 52, for example in the form of a gas heating boiler. A heating circuit 54 which leads for example through various radiators of a building is also present. A secondary heat exchanger 56, via which service water can be heated is moreover provided. A switch-over valve which selectively leads the heat transfer medium flow through the heating circuit 54 or the secondary heat exchanger 56 is usually required in such heating facilities. Regarding the centrifugal pump assembly 1 according to the invention, this valve function is assumed by the valve element 18 which is integrated into the centrifugal pump assembly 1. The control is effected by the control device 17 in the electronics housing 16. The heat source 52 is connected to the delivery branch 27 of the pump casing 12. A flow path 58 is connected to the suction branch 32, whereas a flow path 60 through the heating circuit 54 is connected to the suction branch 34. One can therefore switch between the flow path 58 through the secondary heat exchanger 56 and the flow path through the heating circuit 54 depending on the switching position of the valve element 18, without a valve with an additional drive becoming necessary.

Figure 8:
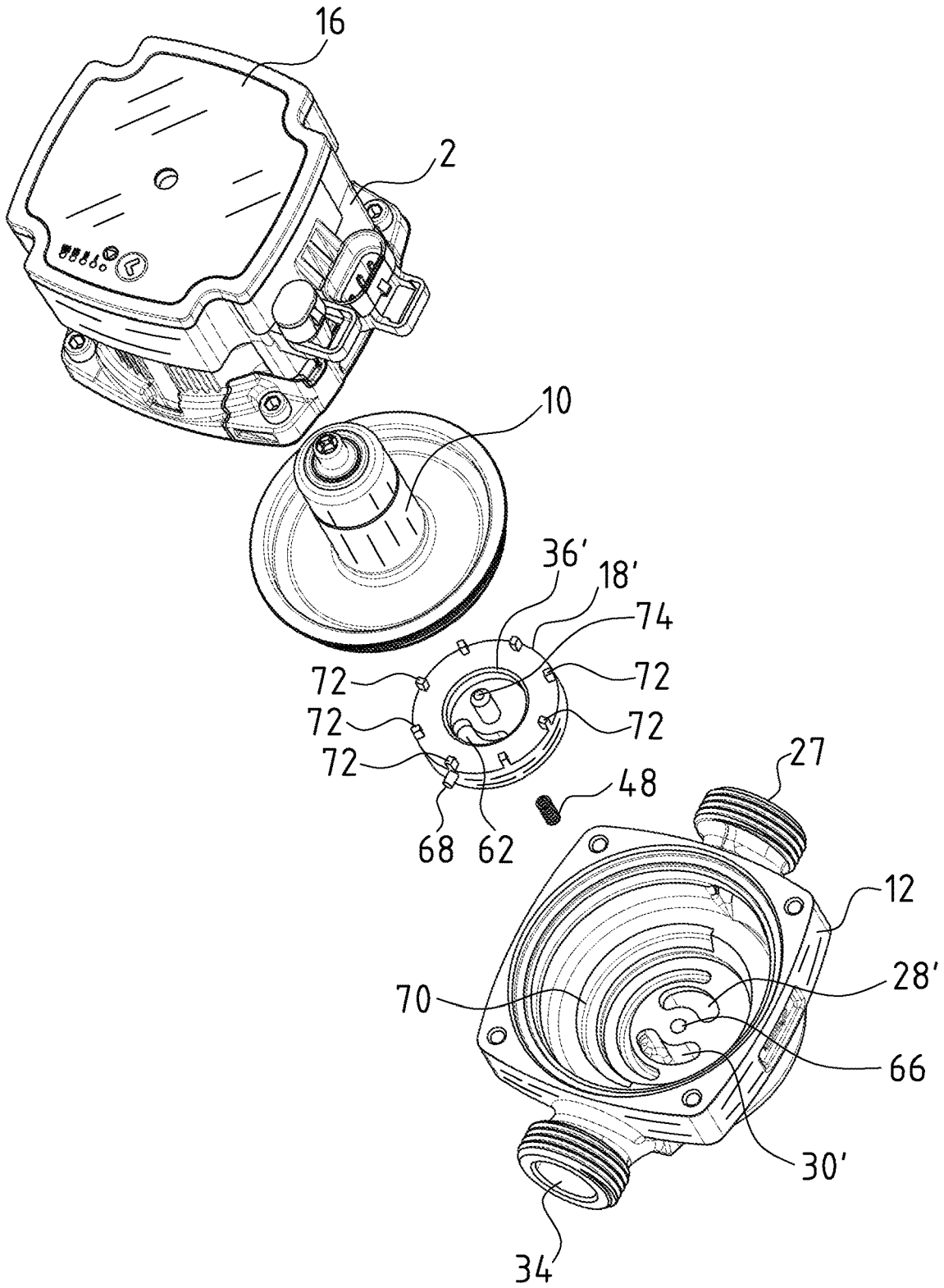
FIG. 8 is an exploded view of a centrifugal pump assembly according to a second embodiment of the invention.
Figure 10:
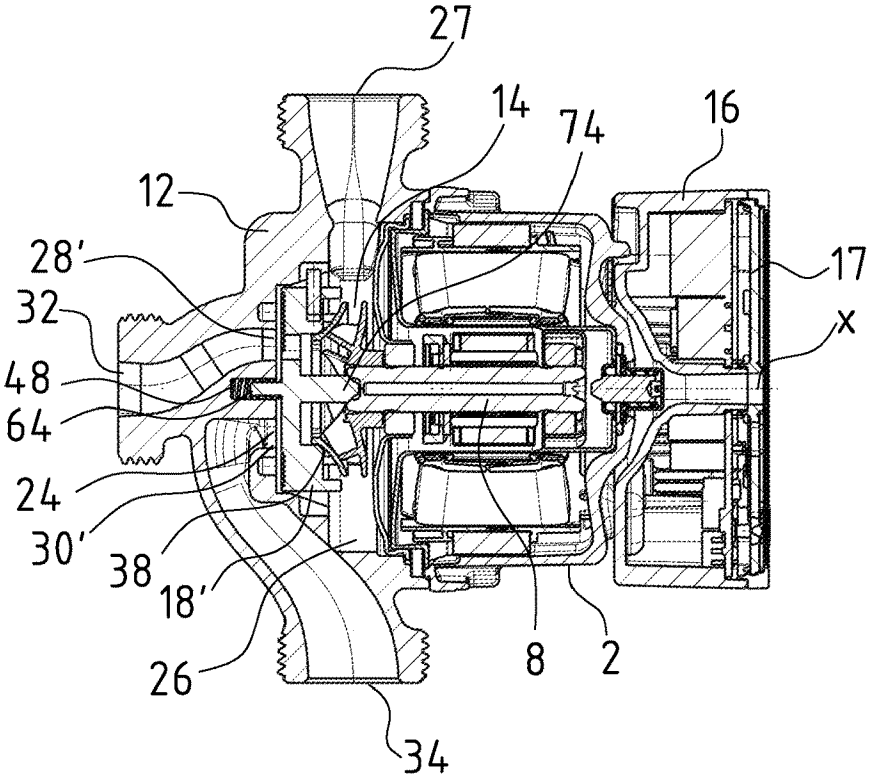
FIG. 10 is a sectional view according to FIG. 9 with the valve element in a second position.
Figure 9:
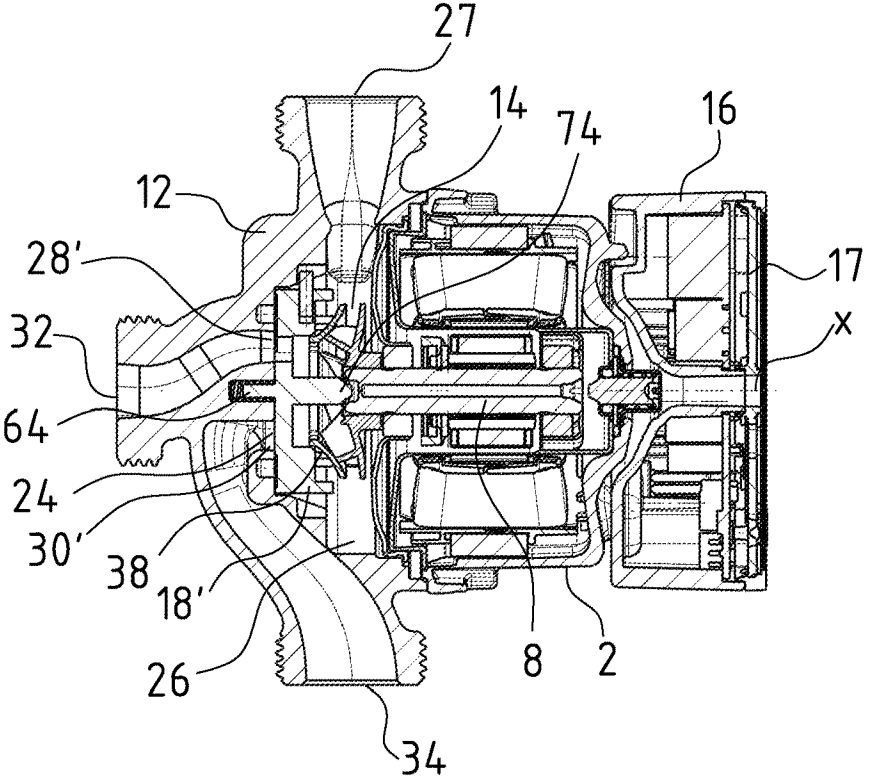
FIG. 9 is a sectional view of the centrifugal pump assembly according to FIG. 8 with the valve element in a first position.

The second embodiment example according to FIGS. 8 to 10 differs from the first embodiment example in respect to the construction of the valve element 18'. In this embodiment example too, the valve element 18' separates the delivery chamber 26 from a suction chamber 24 of the pump casing 12. The valve element 18 comprises a central suction opening 36', into which the suction port 38 of the impeller 14 sealingly engages. Opposite the suction opening 36, the valve element 18' comprises an opening 62 which can be selectively brought to overlap with one of the inlets 28, 30 depending on the switching position of the valve element 18'. In this embodiment example, the inlets 28', 30' with regard to their shaping differ from the inlets 28, 30 according to the preceding embodiment. The valve element 18' comprises a central projection 64 which engages into a central hole 60 in the base of the pump casing 12 and is rotatingly mounted there about the rotation axis X. The projection 64 in the hole 66 simultaneously permits an axial movement along the rotation axis X, said movement being limited in one direction by the base of the pump casing 12 and in the other direction by the impeller 14. At its outer periphery, the valve element 18' comprises a pin 68 which engages into a semicircular groove 70 on the base of the pump casing 12. The ends of the groove 70 serve as stop surfaces for the pin 68 in the two possible switching positions of the valve element 18', wherein in a first switching position the opening 62 lies above the inlet 28' and in the second switching position the opening 62 lies above the inlet 30' and the respective other inlet is closed by the base of the valve element 18'. The rotation movement of the valve element 18' between the two switching positions in this embodiment example too is effected by the flow in the delivery chamber 26, said flow being caused by the impeller 14. The valve element 18' is provided with projections 72 which are directed into the delivery chamber 26, in order to be able to transmit this flow onto the valve element 18' in a better manner. If the centrifugal pump assembly 1 is taken out of operation, the spring 48 presses the valve element 18' into the released position which is shown in FIG. 10 and in which it does not bear on the base in the periphery of the inlets 28' and 30'. In this position, with a central pin 74 it axially abuts upon the face side of the motor shaft 8 and is limited in its axial movement by thus stop. If the pressure in the delivery chamber 26 is adequately large, the valve element 18' is pressed into the bearing position (contacting position) which is shown in FIG. 9 and in which the valve element 18' comes to bear on the base of the pump casing 12 in the peripheral region of the inlets 28' and 30', and the pin 74 is simultaneously lifted from the face side of the rotor shaft 8. In this position, the rotor impeller 14 then rotates in normal operation of the centrifugal pump assembly.

Figure 11:
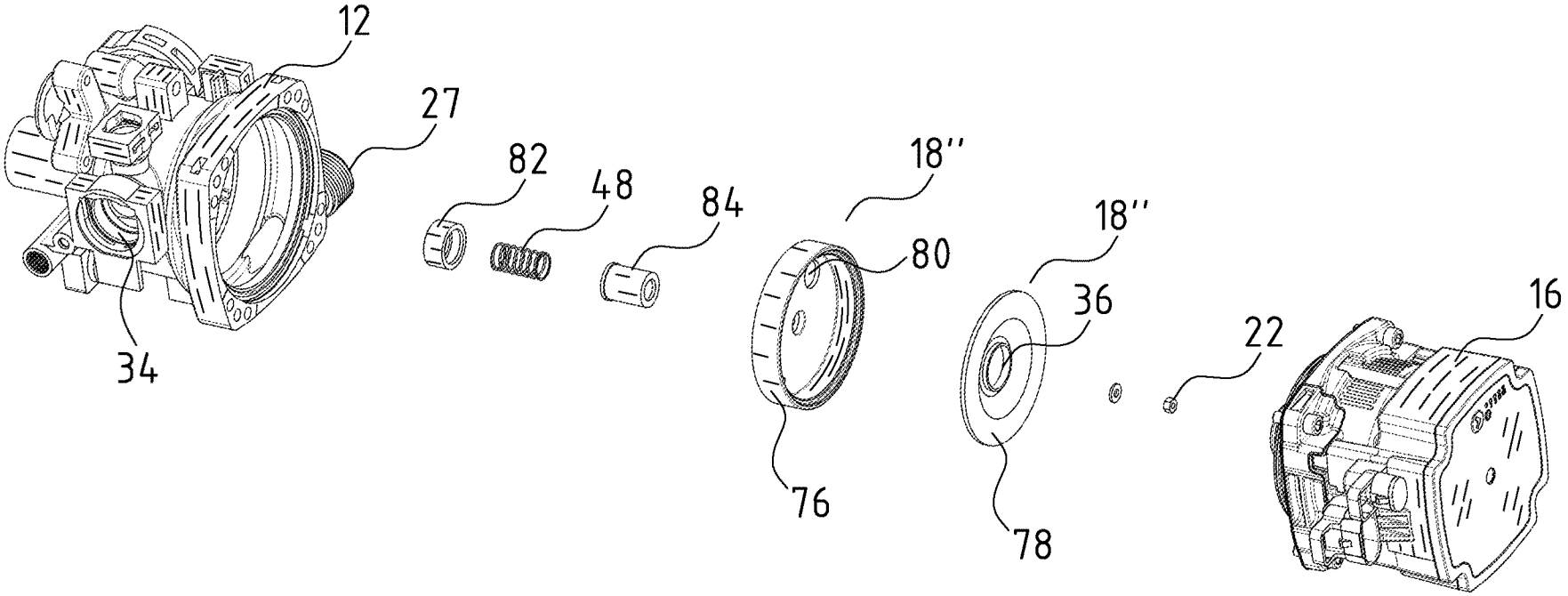
FIG. 11 is an exploded view of the centrifugal pump assembly according to a third embodiment of the invention.
Figure 13:
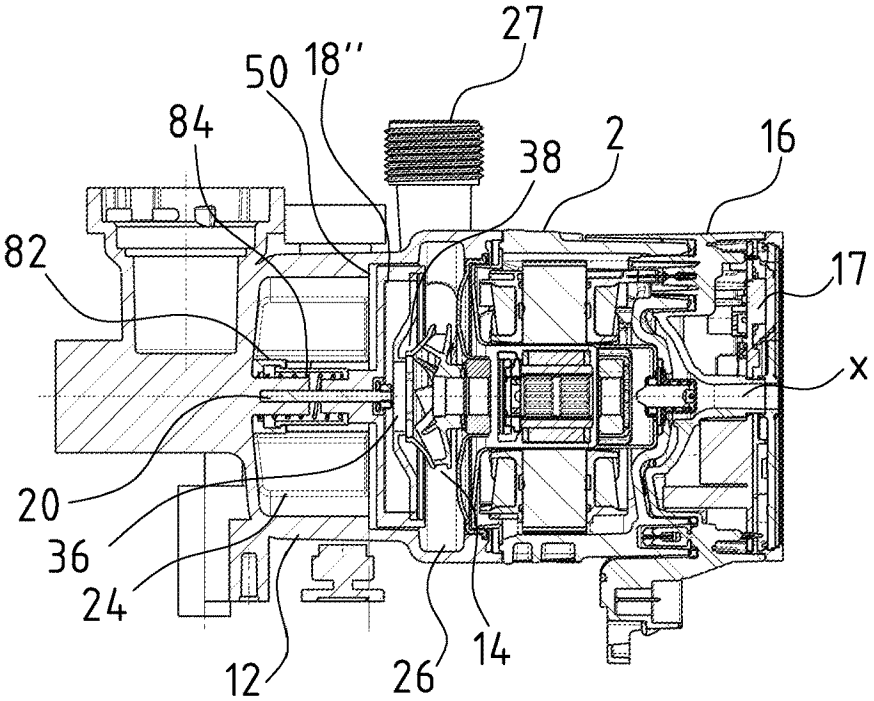
FIG. 13 is a sectional view according to FIG. 12 with the valve element in a second position.
Figure 12:
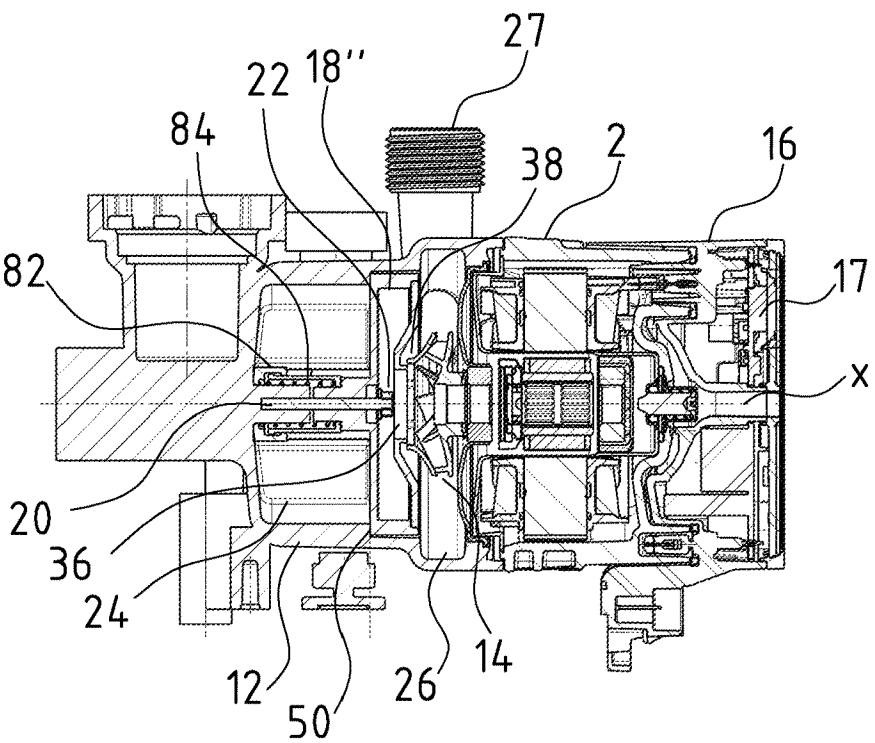
FIG. 12 is a sectional view of the centrifugal pump assembly according to FIG. 11 with the valve element in a first position.

The third embodiment example according to FIGS. 11 to 13 shows a further possible embodiment of the valve element 18". This embodiment example differs from the preceding embodiment examples with regard to the construction of the valve element 18". This valve element is configured as a valve drum. The pump casing 12 corresponds essentially to the construction according to FIGS. 1 to 6, wherein in particular the arrangement of the inlets 28 and 30 corresponds to the arrangement which is described by way of the first embodiment example. The valve drum of the valve element 18" consists of a pot-like lower part which is closed by a cover 78. The cover 78 faces the delivery chamber 26 and comprises the central suction opening 36 which engages with its axially directed collar into the suction port 38 of the impeller 14. At the opposite side, the base of the lower part 36 comprises an inlet opening 80 which is brought to overlap with one of thee inlets 28, 30 depending on the switching position, whilst the respective other inlet 28, 30 is closed by the base of the lower part 26. The valve element 18" is rotatably mounted on a pivot 20 which is fastened in the base of the pump casing 12, wherein the rotation axis which is defined by the pivot 20 corresponds to the rotation axis X of the impeller 14. In this embodiment example too, the valve element 18" is axially displaceable along the pivot 20 by a certain amount, wherein a spring 48 which in the idle position presses the valve element 18" into its released position shown in FIG. 13 is present here too. In this embodiment example too, this axial position is limited by the nut 22. In the released position, the valve element 18" is rotatable by way of the flow which is created by the impeller 14 as described previously, which is to say a hydraulic coupling between the impeller 14 and the valve element 18" is created. In the bearing position which is shown in FIG. 12, on the one hand one of the inlets 28, 30 is sealingly closed depending on the switched position. On the other hand, a sealing between the suction chamber 24 and the delivery chamber 26 is effected due to the valve element 18" bearing on the contact shoulder 50.

In this embodiment example, the mounting of the valve element 18" on the pivot 20 is moreover encapsulated by two sleeves 82 and 84, so that these regions are protected from contamination by the delivered fluid and can be possibly pre-lubricated. A very easy-motion mounting is sought after, in order to ensure the easy rotatability of the valve element 18" by the flow which is caused by the impeller 14. It is to be understood that the mounting can be encapsulated accordingly also in the case of the other embodiment examples which are described here.

Figure 14:
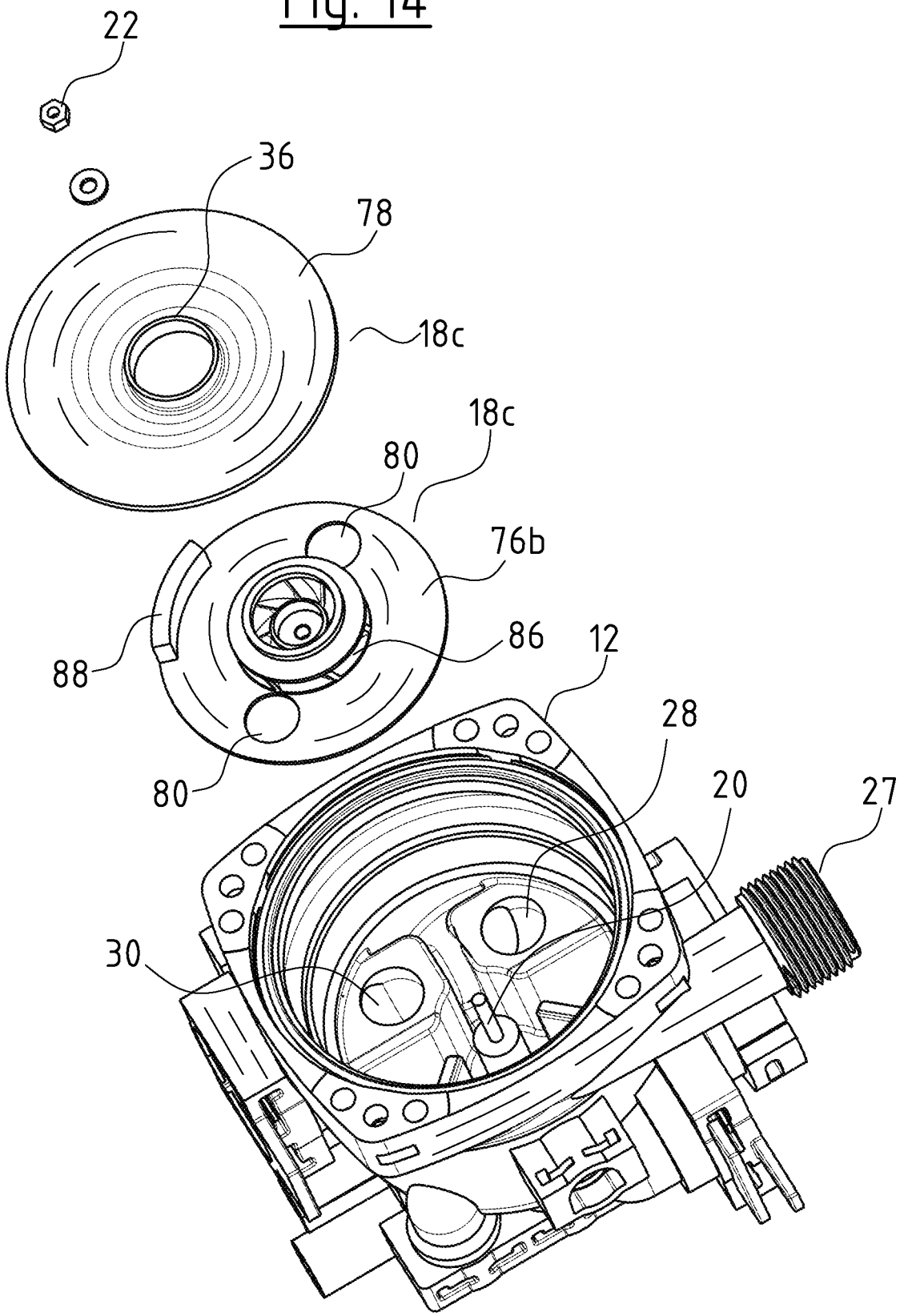
FIG. 14 is an exploded view of a pump assembly with a valve element according to a fourth embodiment of the invention.
Figure 15:
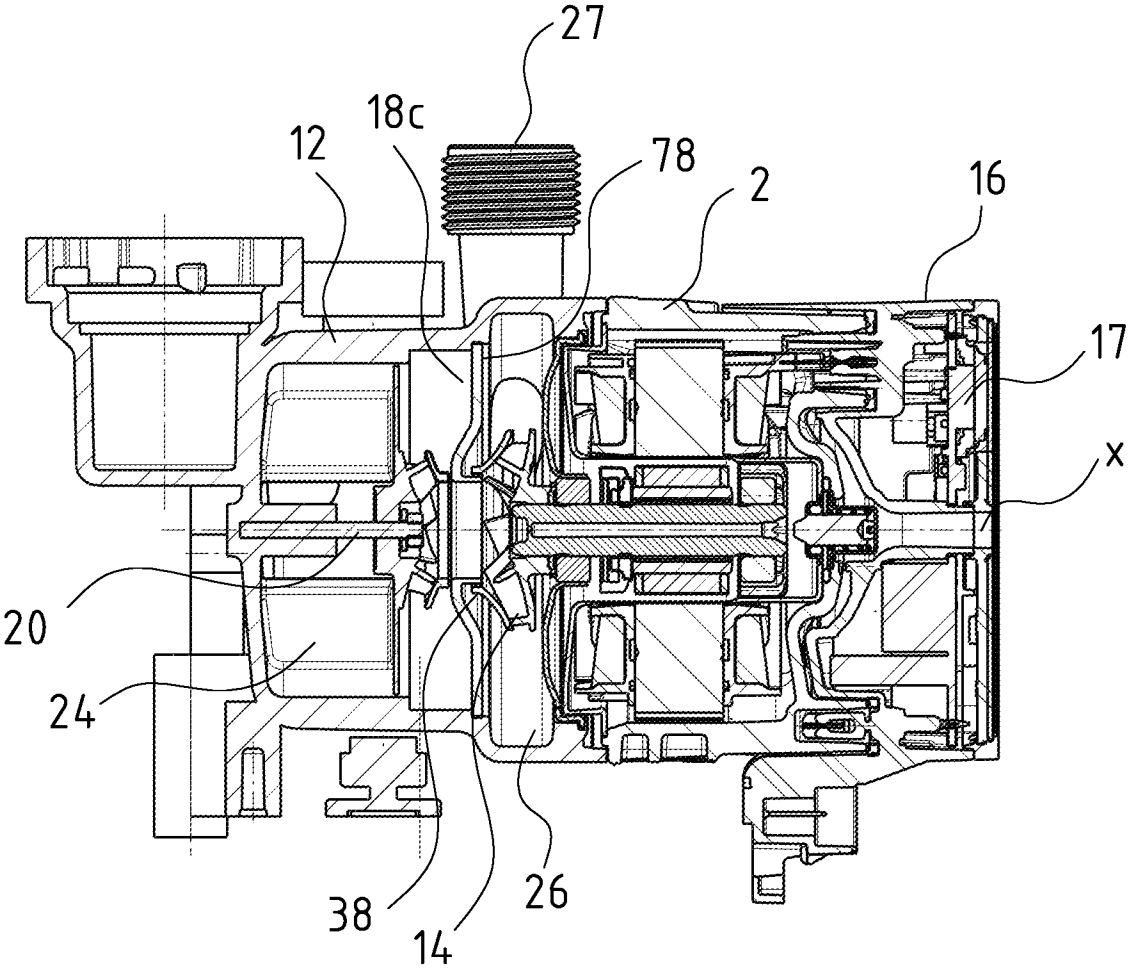
FIG. 15 is a sectional view of a centrifugal pump assembly according to the fourth embodiment of the invention.

FIGS. 14 and 15 show a fourth embodiment example, concerning which the construction of the pump casing 12 corresponds to the construction of the pump casing 12 according to the first and the third embodiment example. In this embodiment example, the rotation movement of the valve element 18*c* is assisted by the suction-side flow, which is to say the flow which enters into the suction port 38 of the impeller 14. In this embodiment too, the valve element 18*c* is configured in an essentially drum-like manner and comprises a cover 28 which faces the delivery chamber 26 and which is with a central suction opening 36 which is engaged with the suction port 38 as has been described beforehand. The lower part 76*b* which is shown here comprises two entry openings 80 which can be brought to overlap with one of the inlets 28, 30 depending on the switching position, wherein the respective other inlet 28, 30 is sealingly closed by the base of the lower part 46*b*, as has been described with the preceding embodiment example. Guide vanes 86 with blades, into which the flow enters radially from the inlet openings 80 and exits axially to the central suction opening 36 are arranged between the lower part 76*b* and the cover 78. A torque about the pivot 20 is also produced by the blades of the guide vanes 86, by way of which torque the valve element 18*c* can be moved between the switching positions. This functions essentially as has been described previously. A spring 48, as has been described previously, can additionally be provided, in order to move the valve element 18*c* into a released position. With this embodiment example, the restoring movement is effected by a weight 88, since a torque is always produced in the same direction independently of the direction, in which the impeller 14 rotates, on account of the shaping of the blades of the guide vanes 86. On operation, the centrifugal pump assembly is always situated in the installation position which is shown in FIG. 15 and in which the rotation axis X extends horizontally. When the centrifugal pump assembly is switched off, the valve element 18*c* always rotates about the pivot 20 such that the weight 88 lies at the bottom. The valve element 18*c* can be rotated against this restoring force which is produced by the weight 88, by way of the torque produced by the guide vanes 86, wherein a pressure can be built up in the delivery chamber 26 in such a rapid manner by way of a very rapid starting operation of the drive motor, that the valve element 18*c* gets into its bearing position (contacting position), as has been described above, in which position it is non-positively held on the pump casing 12 in a rotationally fixed manner without having to be moved out of its idle condition. It is to be understood that a restoring of the valve element by way of gravity or by way of another restoring force independently of the drive could also be applied to the other embodiment examples which are described here.

Figure 16:
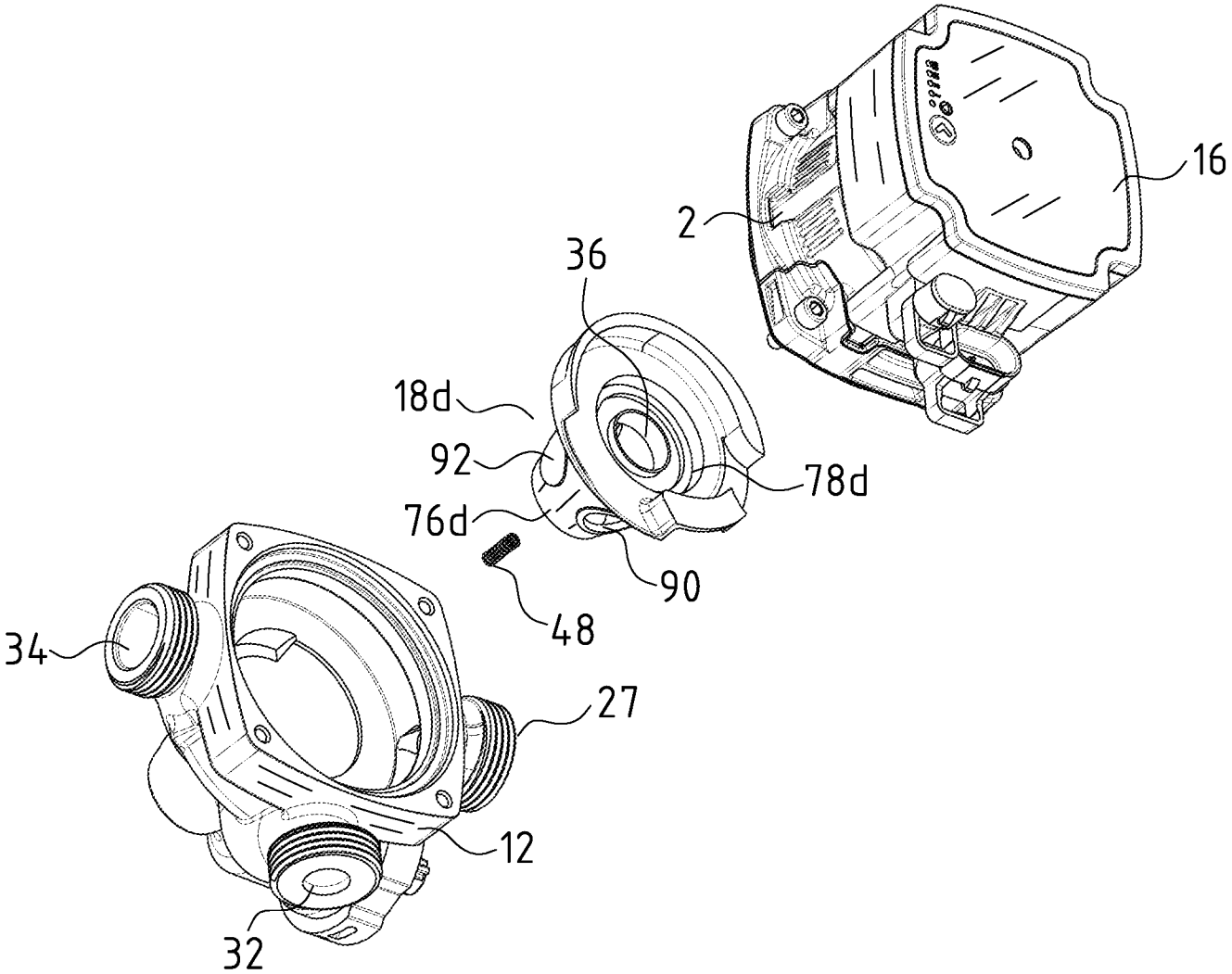
FIG. 16 is an exploded view of a centrifugal pump assembly according to a fifth embodiment of the invention.
Figure 18:
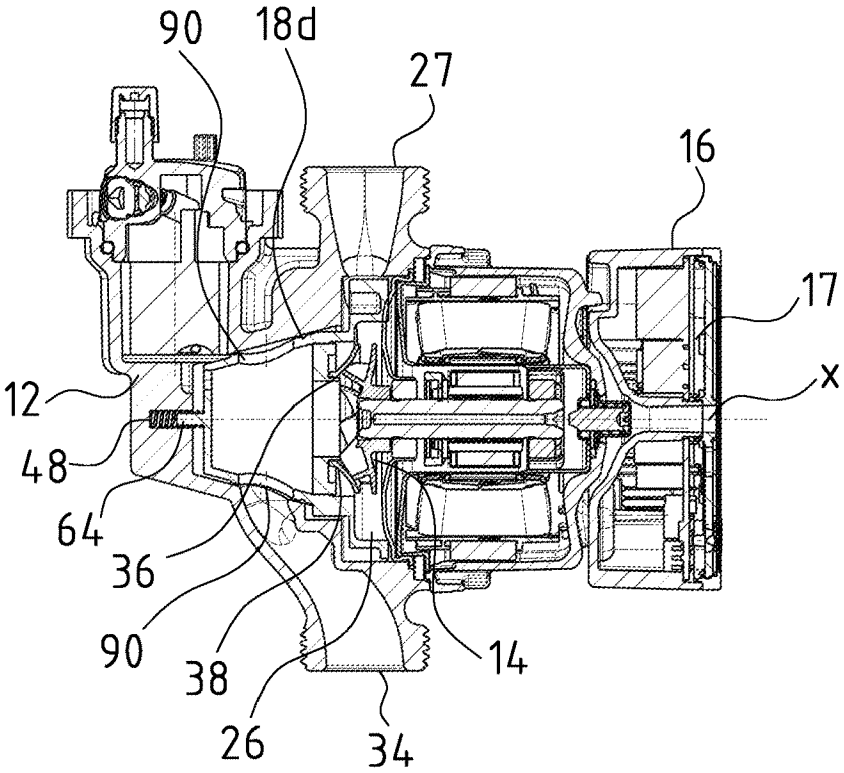
FIG. 18 is a sectional view according to FIG. 17 with the valve element in a second position.
Figure 17:
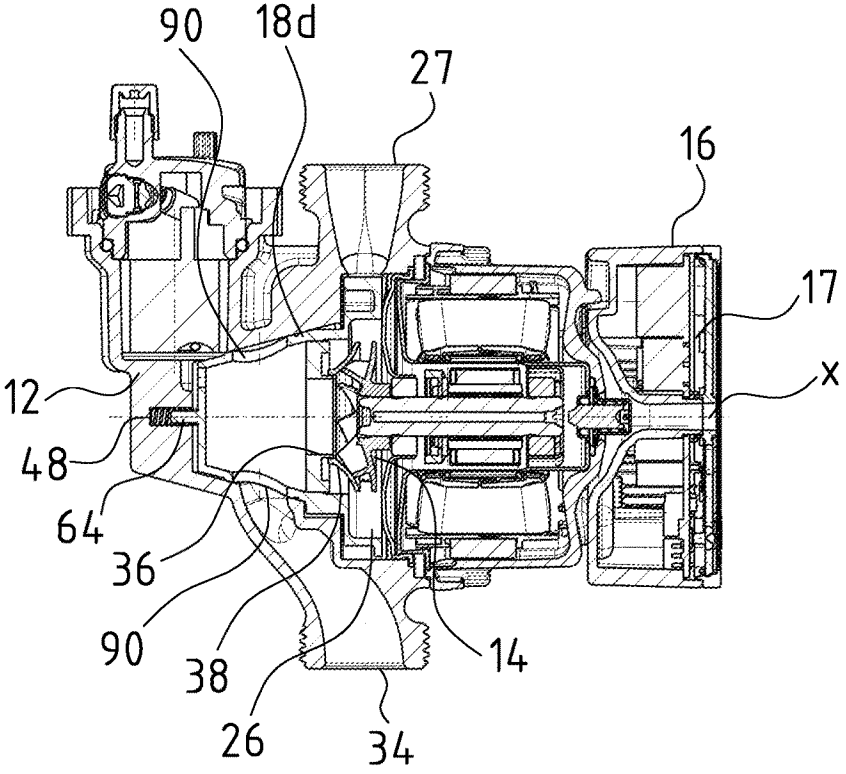
FIG. 17 is a sectional view of the centrifugal pump assembly according to FIG. 16 with the valve element in a first position.
Figure 19:
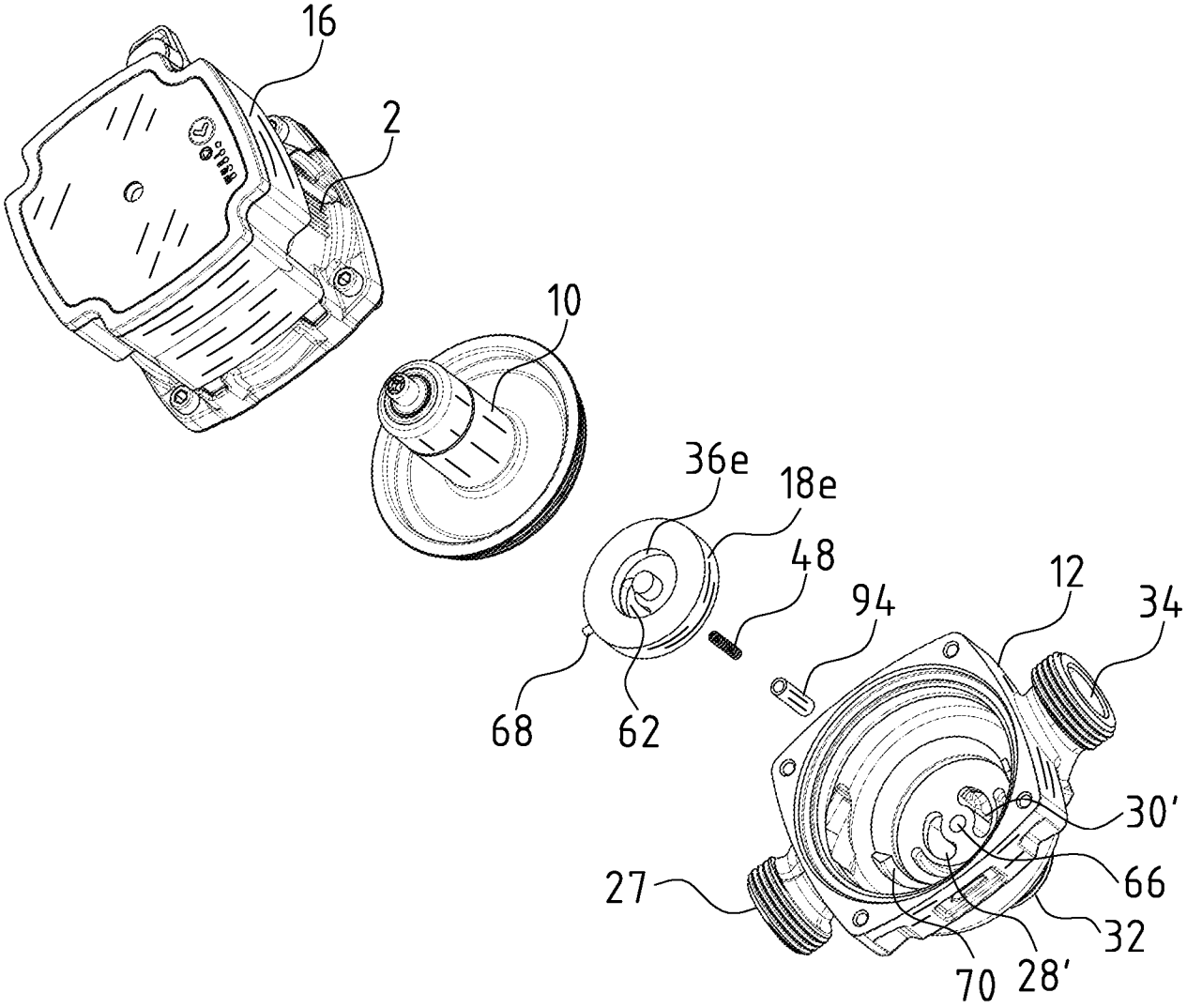
FIG. 19 is an exploded view of a centrifugal pump assembly according to a sixth embodiment of the invention.
Figure 20:
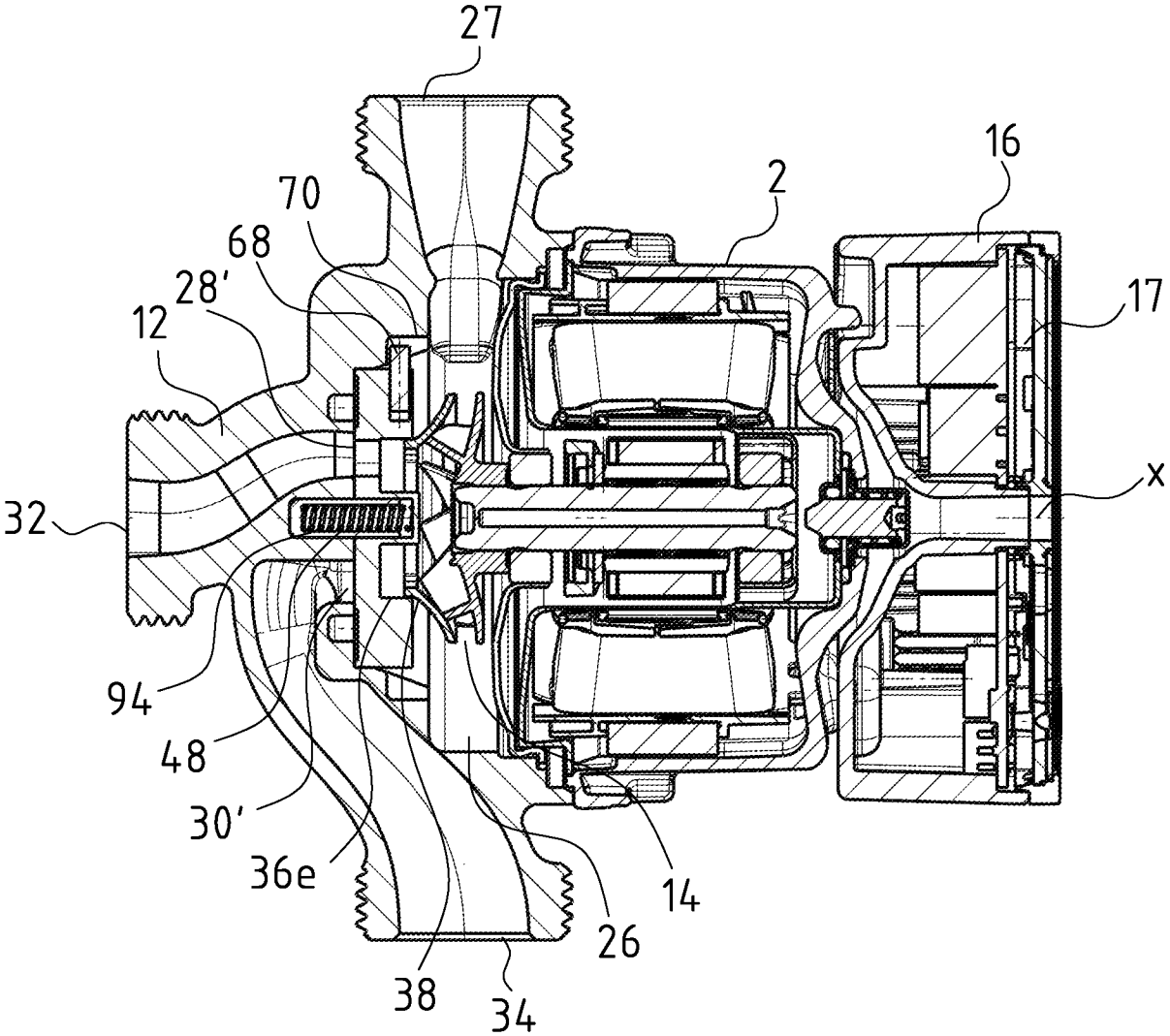
FIG. 20 is a sectional view of the centrifugal pump assembly according to FIG. 19.

The fifth embodiment example according to FIGS. 16 to 18 differs from the preceding embodiment examples again in the construction of the valve element. With regard to this embodiment example, the valve element 18*d* is configured conically. The valve element 18*d* comprises a conical, pot-like lower part 76*d* which is closed by a cover 78*d*, wherein a central suction opening 36 which is engaged with the suction port 38 of the impeller 14 in the previously described manner is again formed in the cover 78*d*. Inlet openings 90 which by way of rotating the valve element 18*d* can be selectively brought to overlap with inlets which are connected to the suction branches 32 and 34, in order to create a flow path through the inside of the valve element 18*d* to the suction opening 36 are formed in the conical peripheral surface of the lower part 76*b*. Sealing surfaces 92 which can close the respective other inlet are formed on the conical lower part between the inlet openings 90. As also with the second embodiment example according to FIGS. 8 and 10, here the valve element 18*d* also comprises a pin-like projection 64 which engages in a recess on the base of the pump casing 12 and there rotatably mounts the valve element 18*d* about the rotation axis X. Here too, an axial movement is possible between a released position, as is shown in FIG. 18 and a bearing position as is shown in FIG. 17. In the released position, the lower part 76*d* of the valve element 18*d* essentially does not bear on the pump casing 12 so that it can be rotated by the flow in the delivery chamber 26 as has been described with regard to the previously described embodiment examples. Here, a to-and-fro movement of the valve element 18*d* can again be achieved in a manner dependent on the rotation direction of the impeller, wherein here too, the rotation movement of the valve element 18*d* can also be limited by stops which are not shown. In the bearing position according to FIG. 17, on the one hand a sealing bearing contact of the valve element 18*d* is effected, and on the other hand it is non-positively held, so that again, as long as the pressure in the delivery chamber 26 is sufficiently large, it is not moved between the switching positions even given a direction change of the impeller 14.

The sixth embodiment example according to FIGS. 19 to 22 is similar to the embodiment example 2 according to FIGS. 8 to 10. The pump casing 12 corresponds essentially to the construction which is represented there and has been described. The motor casing 2 with the electronics housing 16 and the can 10 also correspond to the construction according to the second embodiment example. The valve element 18*e* has a construction which is very similar to the construction of the valve element 18'. What is merely absent are the projections 76 and pin 74. In contrast, the opening 62 is formed in exactly the same manner. The suction opening 36*e* also corresponds essentially to the construction of the suction opening 36'. The valve element 18*e* is rotatingly mounted on a hollow pivot which is inserted into the hole 66 in the base of the pump casing 12. In this embodiment example, the spring 48 is arranged in the inside of the hollow axis 94.

Figure 22:
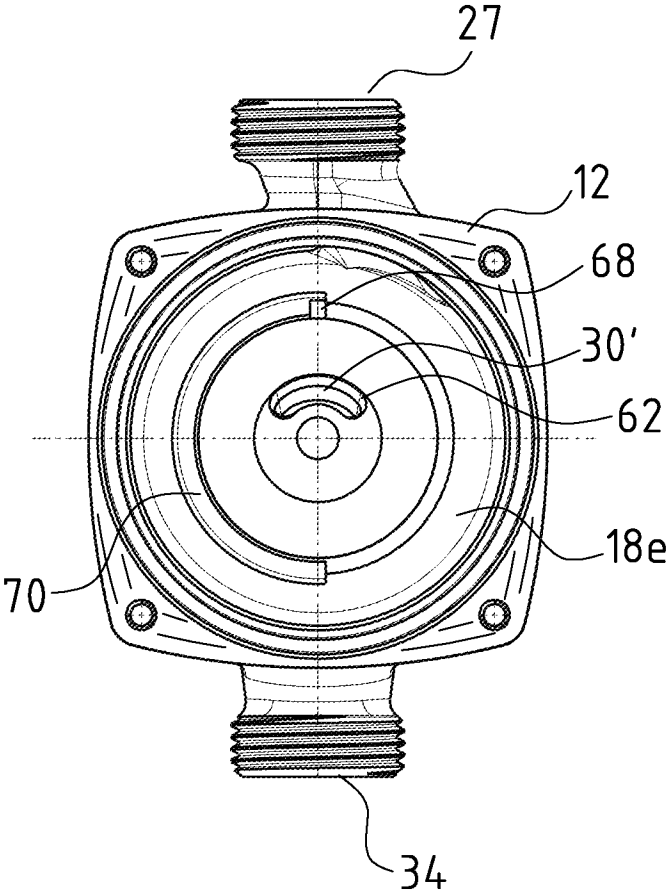
FIG. 22 is a plan view according to FIG. 21 with the valve element in a second switching position.
Figure 21:
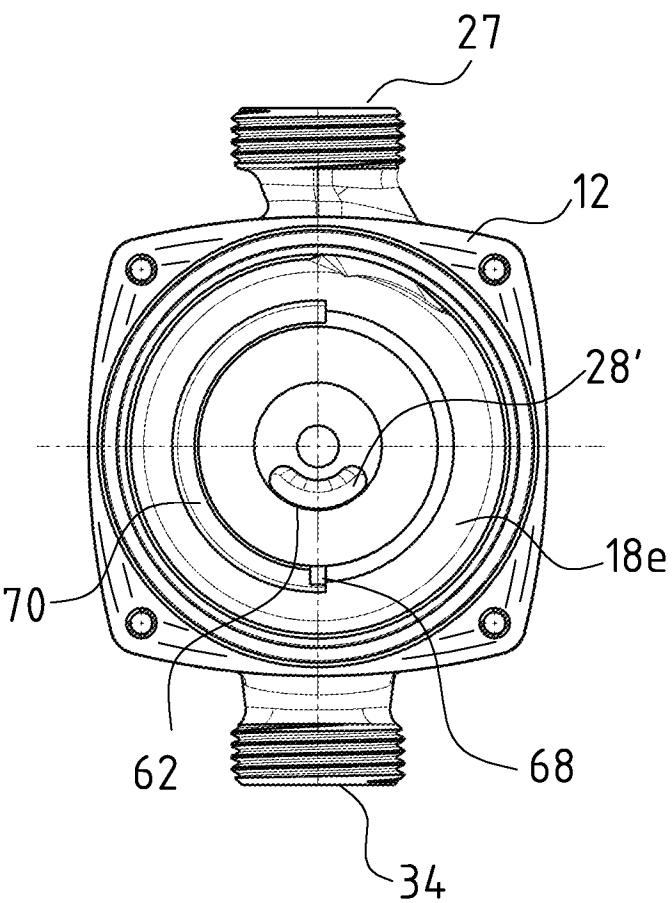
FIG. 21 is a plan view of the opened pump casing of the centrifugal pump assembly according to FIGS. 19 and 20 with the valve element in a first switching position.

Depending on the switching position of the valve element 18*e*, the opening 62 either comes to lie over the inlet 28' or the outlet 30', in order to either open a flow path from the suction branch 32 to the impeller 14 or from the suction branch 34 to the impeller 14. In this embodiment too, the valve element 18*e* is additionally axially movable along the rotation axis X which is the rotation axis of the impeller 14 and of the valve element 18*e*. In an idle position, in which the centrifugal pump assembly is not in operation, the valve element 18*e* is pushed by the spring 48 into a released position, in which the surface of the valve element 18*e* which is away from the impeller 14 is distanced to the base of the pump casing 12, so that the valve element 18*e* can be rotated to and fro about the axis 94 in an essentially free manner between the stops which are formed by the pin 68 and the groove 70. FIG. 21 shows the first switching position, in which the opening 62 lies opposite the inlet 28' and FIG. 22 shows the second switching position, in which the opening 62 lies opposite the second inlet 30'.

With this embodiment example, the rotation of the valve element 18*e* is again effected via the impeller 14, but here a mechanical coupling is provided, said coupling being realized by way of the impeller 14 with its region which surrounds the suction port 38 coming to frictionally bear on the periphery of the suction opening 36*e*. The valve element 18*e* is therefore co-rotated with the impeller 14 until the pin 68 reaches a stop. The coupling then disengages due to slip. Then, with an increasing pressure in the delivery chamber 26, the valve element 18*e* is moved axially into its bearing position as described above, wherein the coupling disengages from the impeller 14, so that the impeller 14 can then rotate in an essentially frictionless manner.

Figure 23:
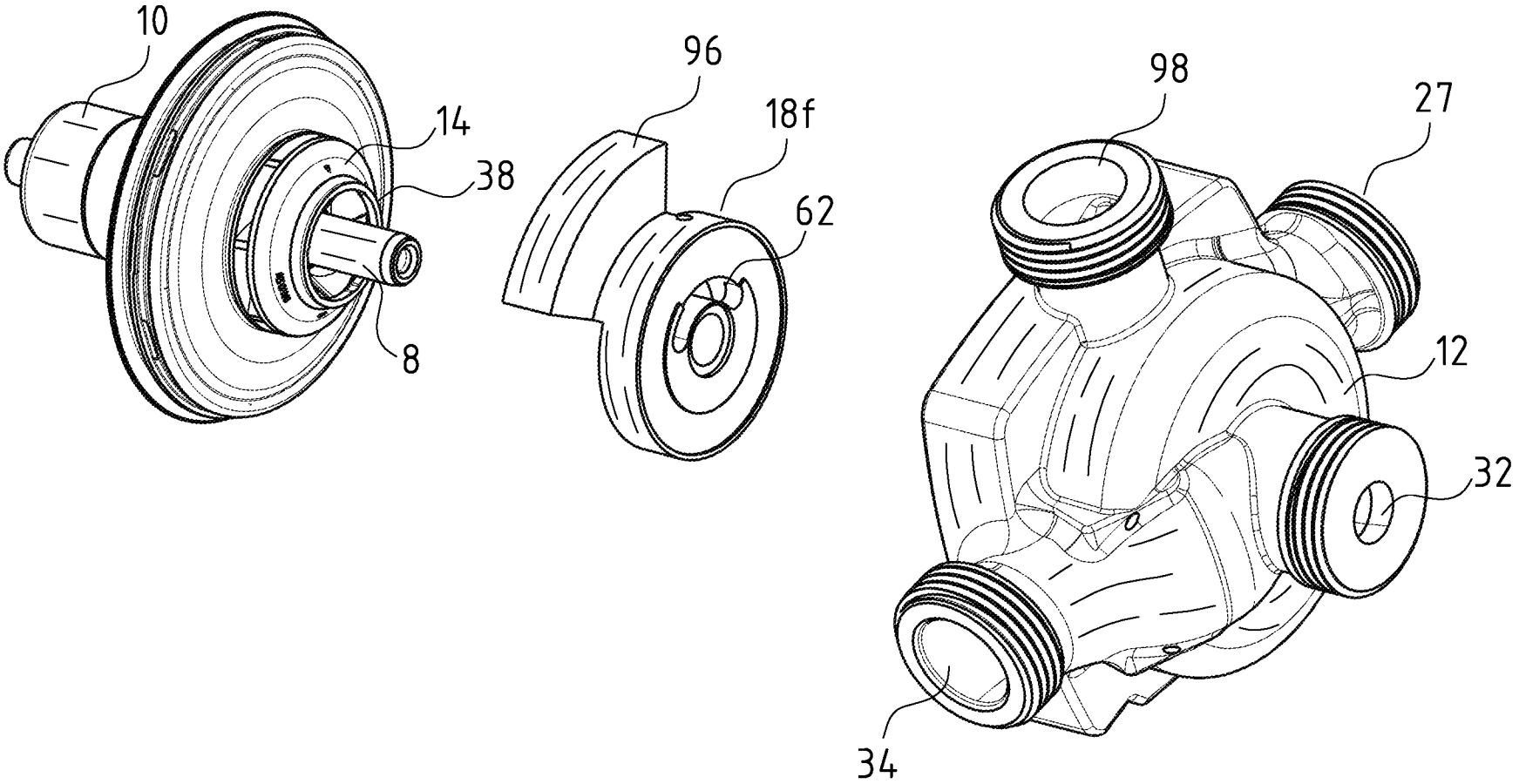
FIG. 23 is an exploded view of a pump casing with a valve element according to a seventh embodiment of the invention.
Figure 24:
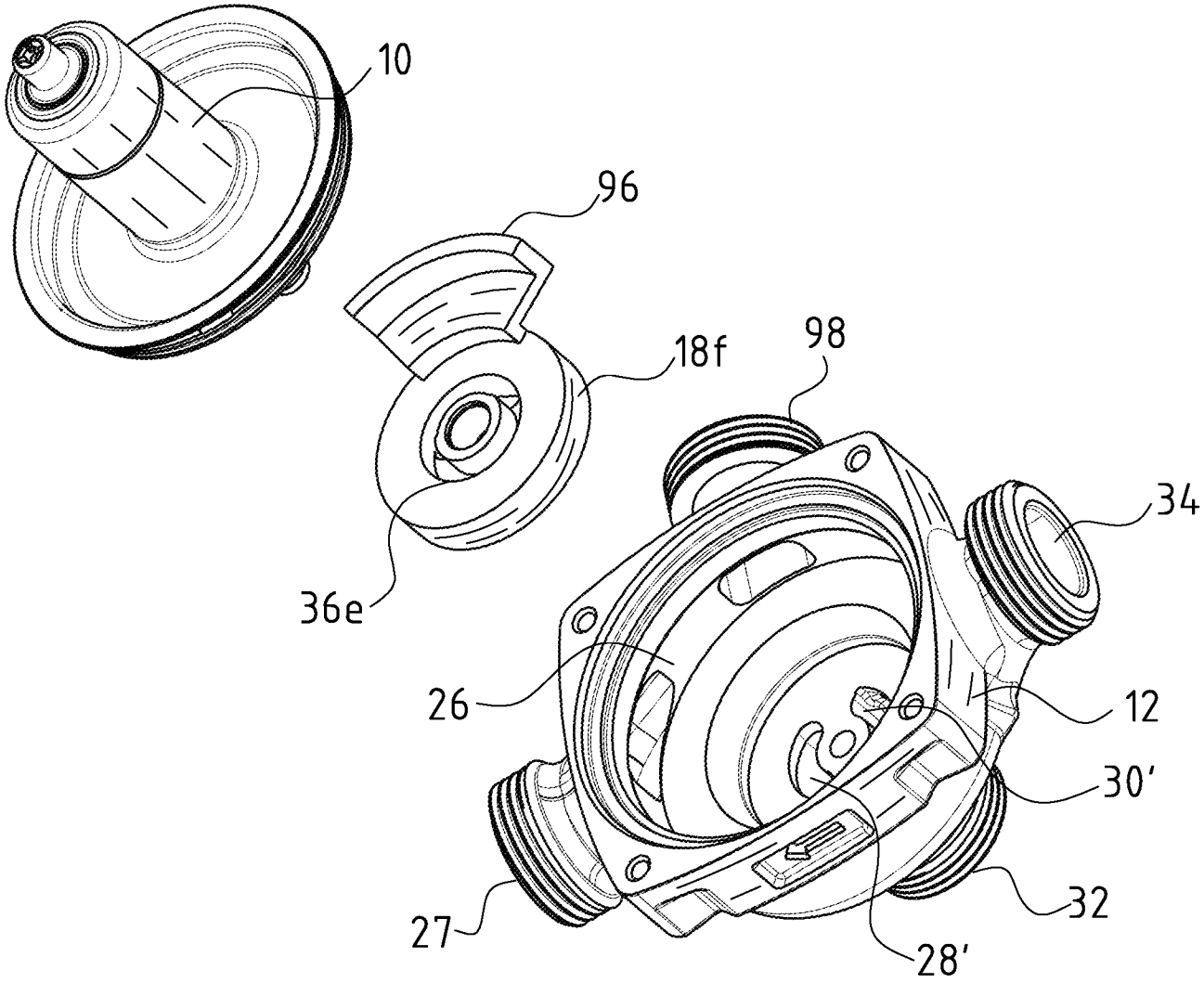
FIG. 24 is an exploded view of the pump casing with the valve element according to the seventh embodiment seen from a different side.
Figure 25:
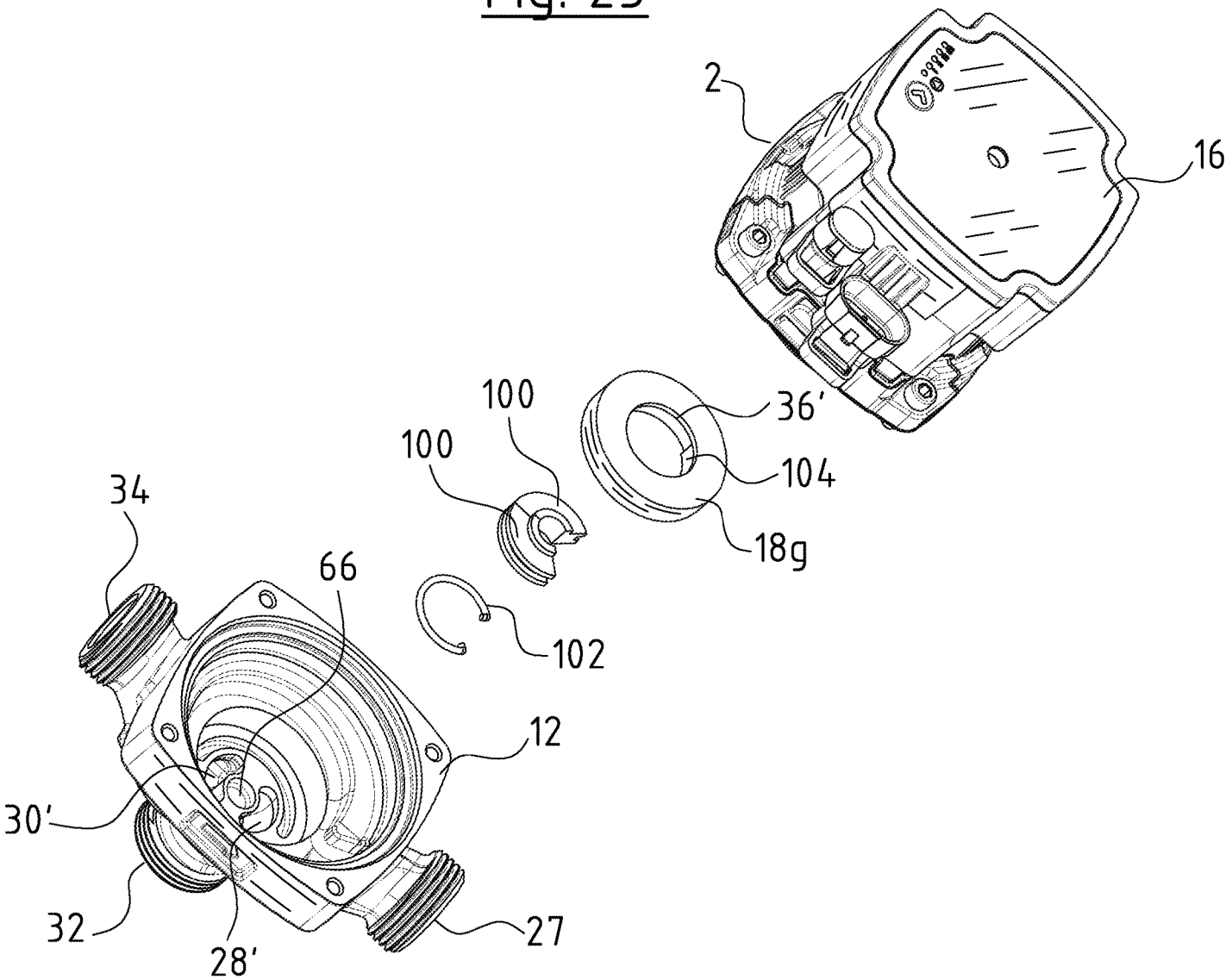
FIG. 25 is an exploded view of a centrifugal pump assembly according to an eighth embodiment of the invention.
Figure 26:
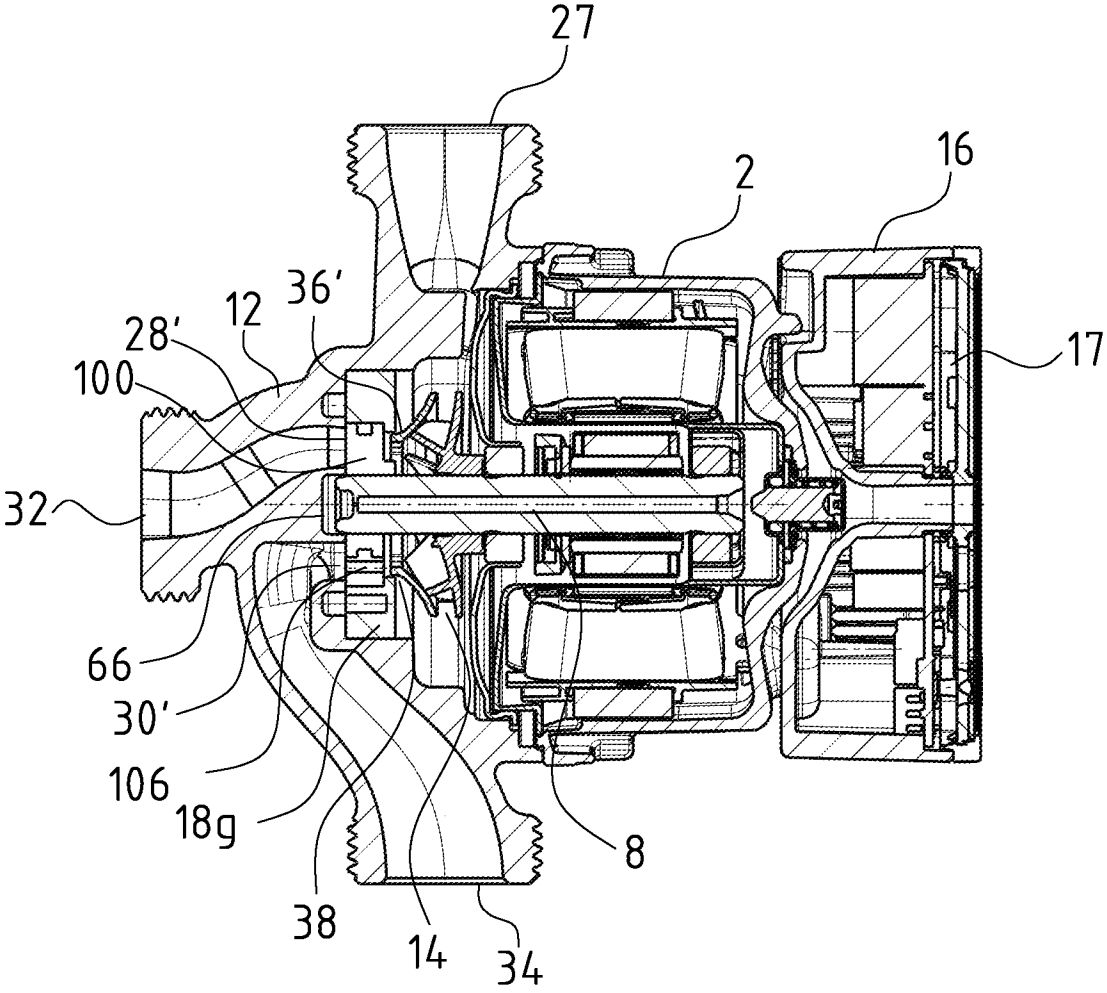
FIG. 26 is a sectional view of the centrifugal pump assembly according to FIG. 25.

The seventh embodiment example according to FIGS. 23 and 24 differs from the previously described sixth embodiment in that a tongue 96 which extends into the delivery chamber 26 and which serves as an additional valve element in the delivery chamber 26 is arranged on the valve element 18*f*. The pump casing 12 comprises an additional delivery branch 98 which runs out into the delivery chamber 26 separately to the delivery branch 27. Depending on the switching position of the valve element 18*f*, the tongue 96 can release the delivery branch 27 or the delivery branch 28 and cover the respective other delivery branch. With this embodiment example therefore, a delivery-side switch-over is envisaged at the delivery side of the impeller 14. A mixing function can be simultaneously realized via the inlets 28' and 30', by way of the opening 92 being positioned such that it covers both these inlets 28', 30' in a first switching position, so that fluid can flow out of the both inlets 28', 30' through the opening 62 and further through the suction port 38. In contrast, in the second switching position the opening 62 covers only the inlet 28', whereas the inlet 30' is closed by the base of the valve element 18*f* in the manner described above. The delivery branch 27 is simultaneously closed and the delivery branch 98 released. The movement of the valve element 18*f* can be realized in the manner described above via the impeller 14 and a mechanical coupling which disengages by way of the axial displacement of the valve element 18*f* given a sufficiently high pressure in the delivery chamber 26. The valve element 18*f* is mounted on the rotor shaft 8 in this embodiment example.

The eighth embodiment according to FIGS. 25 to 28 differs from the sixth embodiment with regard to the configuration of the mechanical coupling between the rotor shaft 8 and the valve element 18*g*. Concerning this embodiment example, the valve element 18*g* is mounted directly on the rotor shaft 8 which is configured in an extended manner and extends up to into the hole 66 in the base of the pump casing 12. Two ring segments 100 with plain bearing characteristics, in particular of ceramic are arranged in the inside of the valve element 18*g*. The ring segments 100 are held together by a clamping ring 102 and are pressed against the rotor shaft 8. In this example, the two ring segments 100 form an essentially ⅔ ring. The valve element 18*g* with a projection 104 on its inner periphery engages in the region of the ring segment which is absent for a complete ring, so that the two ring segments 100 are arranged in the inside of the valve element 18*g* in a rotationally fixed manner A passage 106 which effects the valve function remains in the region of the absent ring segment, which is to say adjacent to the projection 104.

Figure 28:
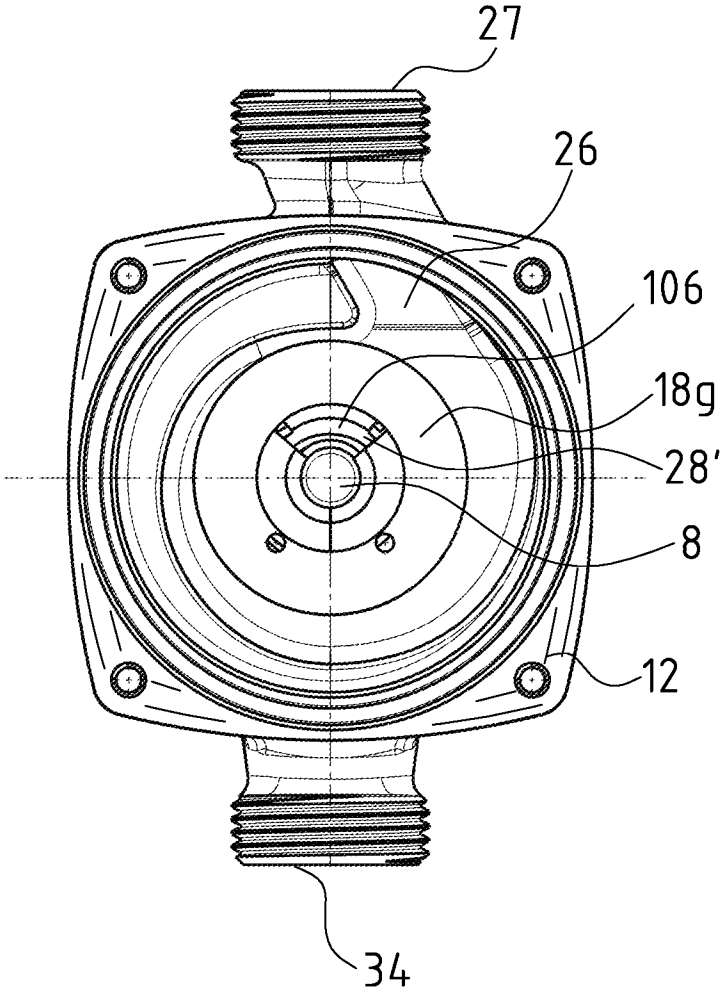
FIG. 28 is a plan view according to FIG. 27 with the valve element in a second switching position.
Figure 27:
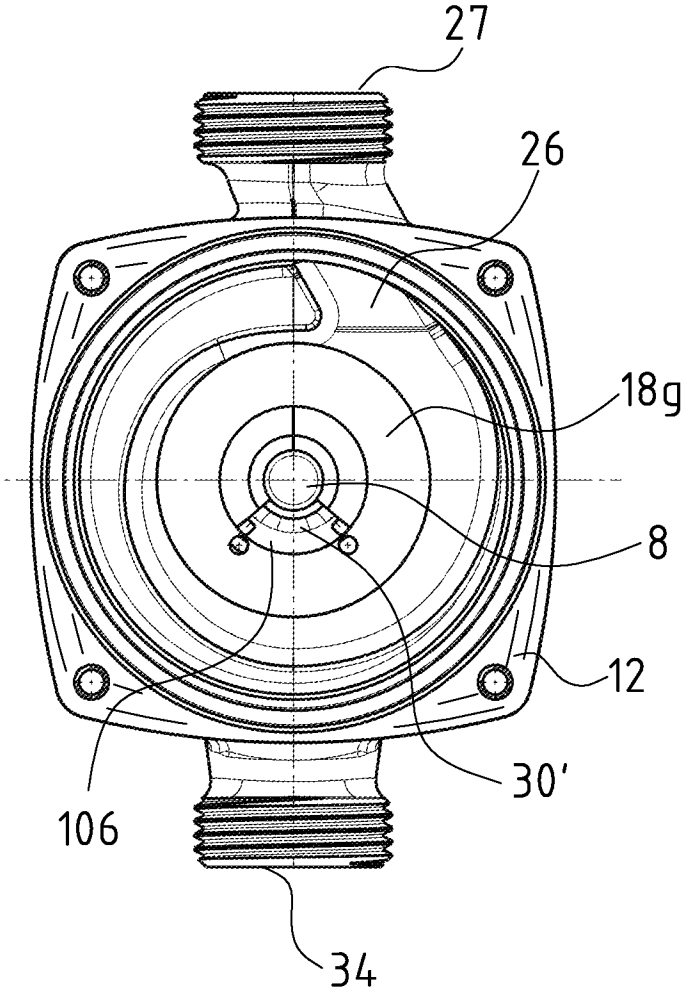
FIG. 27 is a plan view of the opened pump casing of the centrifugal pump assembly according to FIGS. 25 and 26 with the valve element in a first switching position.
Figure 29:
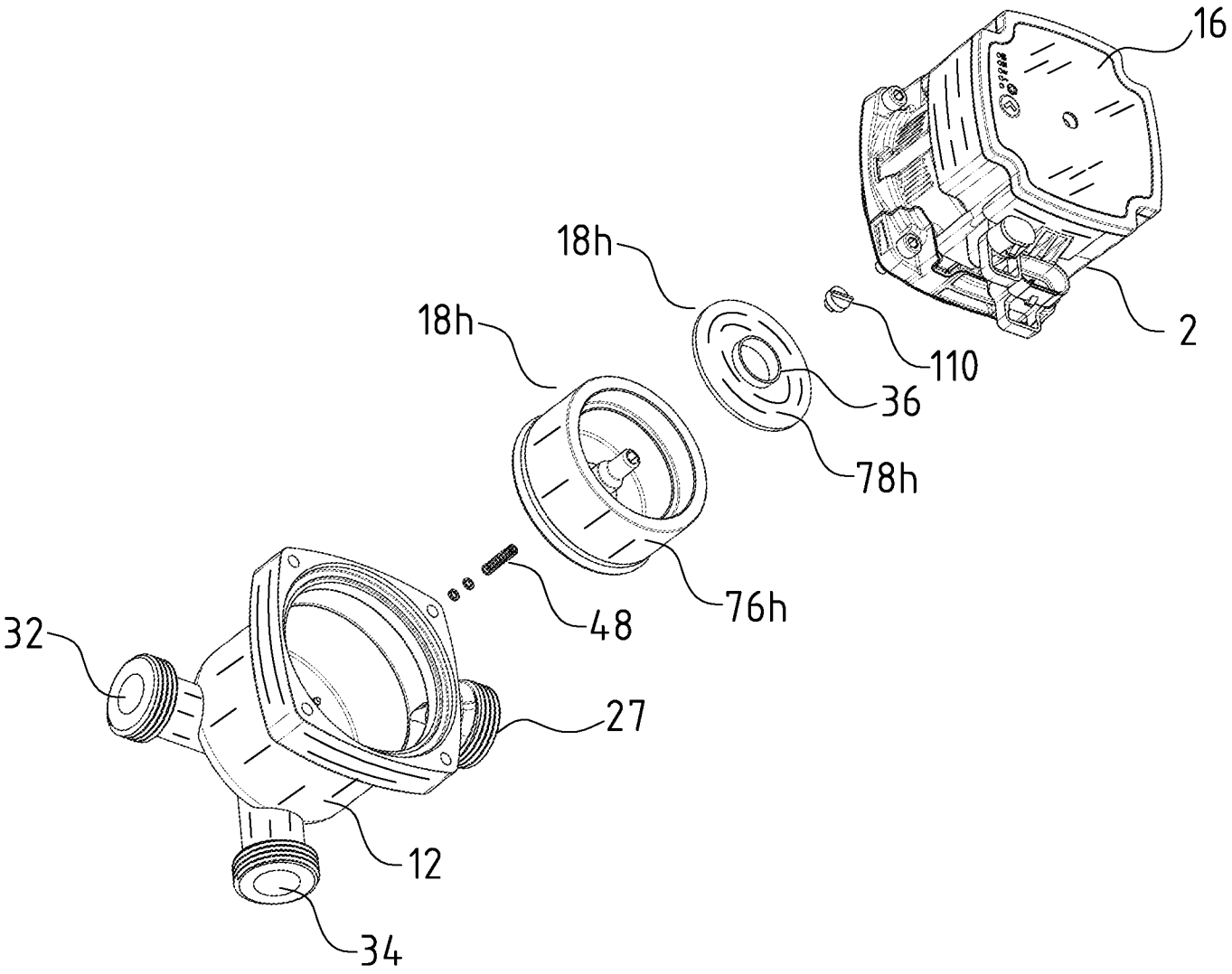
FIG. 29 is an exploded view of the centrifugal pump assembly according to a ninth embodiment of the invention.
Figure 30:
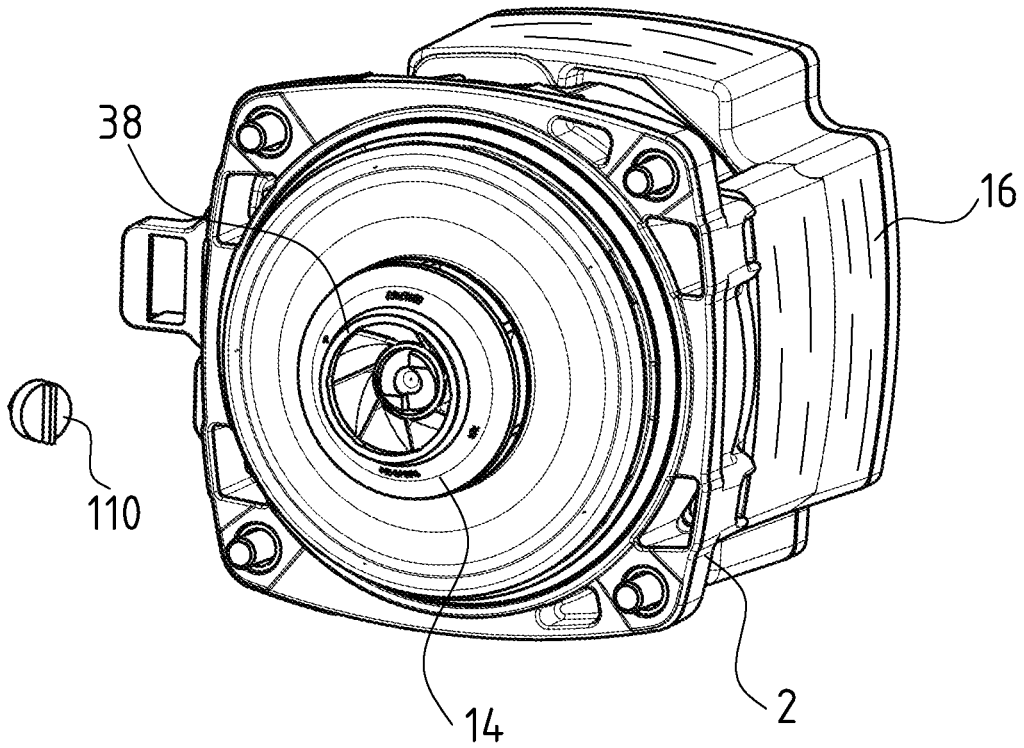
FIG. 30 is a perspective view of the centrifugal pump assembly according to FIG. 29 with a removed pump casing and valve element.
Figure 31:
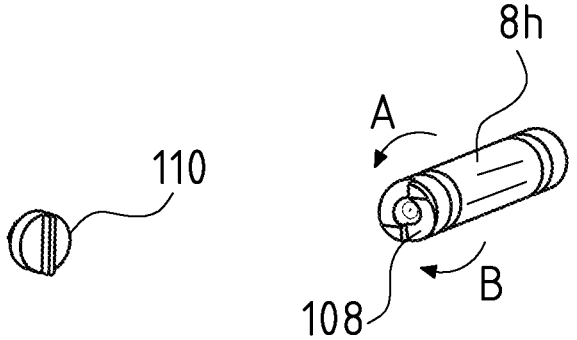
FIG. 31 is a perspective view of the motor shaft of the centrifugal pump assembly according to FIGS. 29 and 30 as well as of the coupling part of the valve element.

In a first switching position which is shown in FIG. 27, the passage 106 can lie opposite inlet 30' and in a second switch position which is shown in FIG. 28 can lie opposite the inlet 28'. The other inlet is closed in each case. For this, the valve element 18*g* can be pressed in the axial direction into bearing contact on the base of the pump housing 2 which surrounds the inlets 28' and 30', by way of the pressure prevailing in the delivery chamber 26, in accordance with the embodiments described above.

The movement of the valve element 18*g* is effected via the drive of the impeller 14. At the start, the rotor shaft 8 bears non-positively on the inner periphery of the ring segments 10 and co-rotates these and thus the valve element 18*g*. Stops for both switching positions can be formed in the pump casing 12 in the manner described above. When the valve element 18*g* reaches one of these stops, then the pump shaft 8 slides through in the inside of the ring segments 100. Moreover, a lubrication film forms between the outer periphery of the rotor shaft 8 and the inner surfaces of the ring segments 100 in the manner of a plain bearing, given an increasing speed of the rotor shaft 8, so that the rotor shaft 8 can then rotate in an essentially frictionless manner in the inside of the ring segments 100. This means that for adjusting or actuating the valve element 18*g* between its two switching positions, the drive motor is moved by the control device 17 preferably at a lower speed than the speed at which the impeller 14 is rotated on operation. The drive motor can be driven in two rotation directions in the manner described above, for moving the valve element 18*g* to and fro, wherein again after reaching the desired switching position, by way of a rapid speed increase, one can succeed in the valve element 18*g* remaining in the previously reached switching position on account of the pressure in the delivery chamber 26 and the bearing contact of the valve element on the base of the pump casing 12, in the manner described above.

With regard to the ninth and tenth embodiment according to FIGS. 29 to 37 as well as 38 to 47, a mechanical coupling is likewise provided between the drive motor and the valve element, wherein concerning these embodiments, the drive motor can be activated in two different operational types or modes by way of the control device 17. In a first operation mode which corresponds to the normal operation of the circulation pump assembly, the drive motor rotates in the conventional manner at a desired speed which can be adjusted, in particular by the control device 17. In the second operating mode, the drive motor is activated (controlled) in open loop operation, so that the rotor can be rotated stepwise in individual angular steps which are smaller than 360°. The drive motor can therefore be moved in individual steps in the manner of a stepper motor, which concerning these embodiment examples is used in order to move the valve element in small angular steps into a defined position in a targeted manner, as is described hereinafter.

With regard to the ninth embodiment according to FIGS. 29 to 37, a mixing valve as can be used for example for temperature adjustment for a floor heating is integrated in the pump casing 2.

Figure 33:
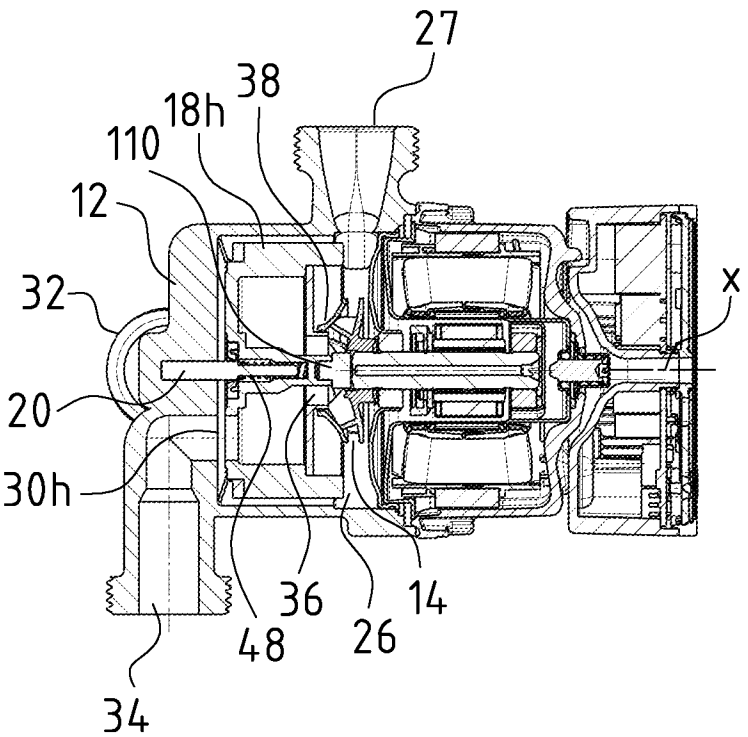
FIG. 33 is a sectional view according to FIG. 32 with the valve element in a second position.
Figure 32:
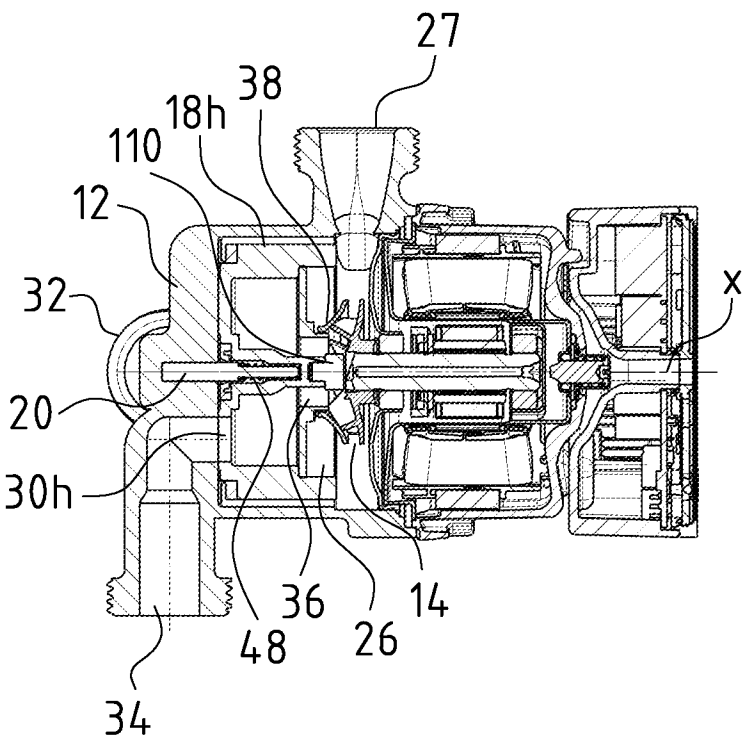
FIG. 32 is a sectional view of the centrifugal pump assembly according to FIG. 29 with the valve element in a first position.

The motor casing 2 with the electronics housing 16 corresponds to the previously described embodiment. The pump casing 12 is constructed in essentially the same manner as the pump casing according to the first embodiment according to FIGS. 1 to 6, and it is only the outer configuration which is different. With this ninth embodiment, the valve element 18*h* is likewise configured in a drum-like manner and consists of a pot-like lower part 76*h* which at its side which faces the impeller 14 is closed by a cover 78*h*. A suction opening 36 is formed in the central region of the cover 78*h*. The valve element 18*h* is rotatably mounted on a pivot 20 which is arranged in the base of the pump casing 12. Here, the rotation axis of the valve element 18*h* corresponds to the rotation axis X of the rotor shaft 8*h*, as is the case with the examples described above. Here, the valve element 18*h* is likewise axially displaceable along the axis X and is pressed by a spring 48 into the idle position which is shown in FIG. 33 and in which the valve element 18*h* is located in released position, in which the lower part 76*h* does not bear on the base of the pump casing 12, so that the valve element 18*h* is essentially freely rotatable about the pivot 20. In the released position, the face end of the rotor shaft 8*h* which is configured as a coupling 108 functions as an axial stop. The coupling 108 engages with a counter coupling 110 which is arranged on the valve element 18*h* in a rotationally fixed manner. The coupling 108 comprises inclined (beveled) coupling surfaces which along a peripheral line essentially describe a saw-toothed profile in a manner such that a torque transmission from the coupling 108 onto the counter coupling 110 is only possible in one rotation direction, specifically in the rotation direction A in FIG. 31. In contrast, the coupling slips through in the opposite rotation direction B, wherein an axial movement of the valve element 18*h* occurs. The rotation direction B is that rotation direction, in which the pump assembly is driven in normal operation. In contrast, the rotation direction A is used for the targeted actuation of the valve element 18*h*. This means that a rotation-direction-dependent coupling is formed here. However, concerning this embodiment too, the counter-coupling 110 also disengages from the coupling 108 due to the pressure in the delivery chamber 26. If the pressure in the delivery chamber 26 increases, then a pressing force which is opposed to the spring force of the spring 48 and which exceeds this acts upon the cover 78*h*, so that the valve element 18*h* is pressed into the bearing position as is shown in FIG. 32. In this position, the lower part 76*h* bears on the base side of the pump casing 12, so that on the one hand the valve element 18*h* is non-positively held and on the other hand a sealed bearing contact is achieved, said bearing contact sealing the delivery side and the suction side with respect to one another in the subsequently described manner.

Figure 36:
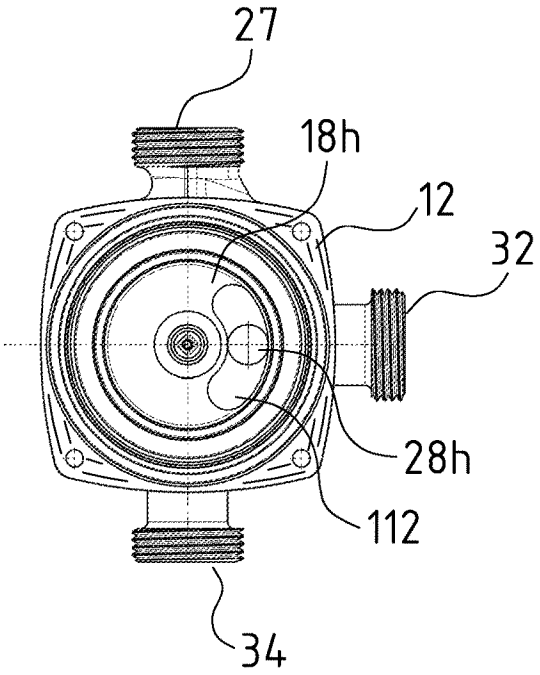
FIG. 36 is a plan view according to FIGS. 34 and 35 with the valve element in a third switching position.
Figure 35:
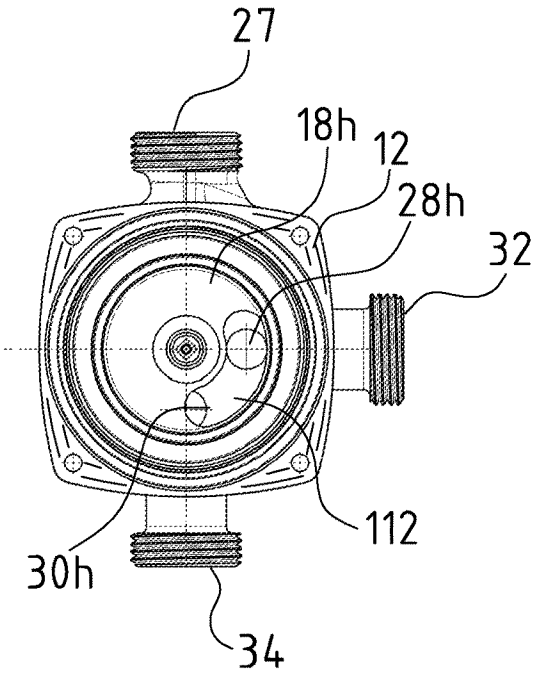
FIG. 35 is a plan view according to FIG. 34 with the valve element in a second switching position.
Figure 34:
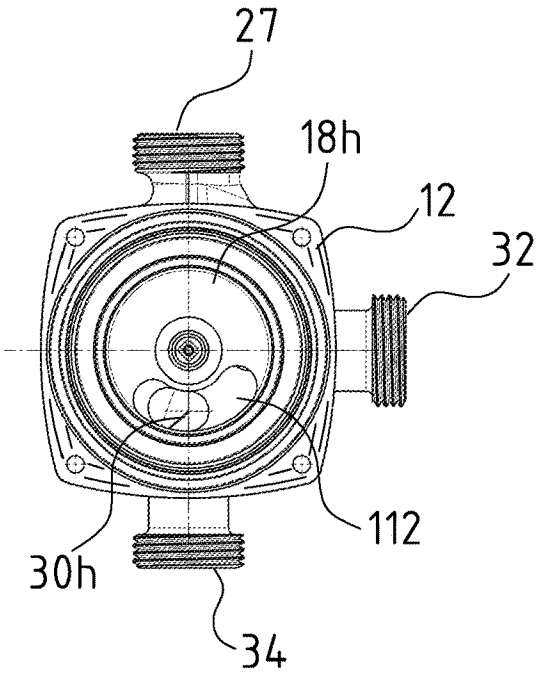
FIG. 34 is a plan view upon the opened pump casing of the centrifugal pump assembly according to FIGS. 29 to 33 with the valve element in a first switching position.

The pump casing 12 comprises two suction branches 32 and 34, of which the suction branch 32 runs out at an inlet 28*h* and the suction branch 34 at an inlet 30*h*, in the base of the pump casing 12 into the interior of this, which is to say into the suction chamber 24. The lower part 76*h* of the valve element 18*h* in its base comprises an arched opening 112 which extends essentially over 90°. FIG. 34 shows a first switching position, in which the opening 112 only overlaps the inlet 30*h*, so that a flow path is only given from the suction branch 34 to the suction opening 36 and therefore to the suction port 38 of the impeller 14. The second inlet 28*h* is sealingly closed by the base of the valve element 18*h* which bears in the peripheral region of this second inlet. FIG. 36 shows the second switching position, in which the opening 112 only overlaps the inlet 28*h*, whilst the inlet 30*h* is closed. In this switching position, only a flow path from the suction branch 32 to the suction port 38 is opened. FIG. 35 now shows an intermediate position, in which the opening 112 overlaps both inlets 28*h* and 30*h*, wherein the inlet 30*h* is only partly released. A mixing ratio between the flows from the inlets 28*h* and 30*h* can be changed by way of changing the degree of release of the branch 30*h*. The valve element 18*h* can also be actuated or adjusted in small steps via the stepwise actuation of the rotor shaft 8*h*, in order to change the mixing ratio.

Figure 37:
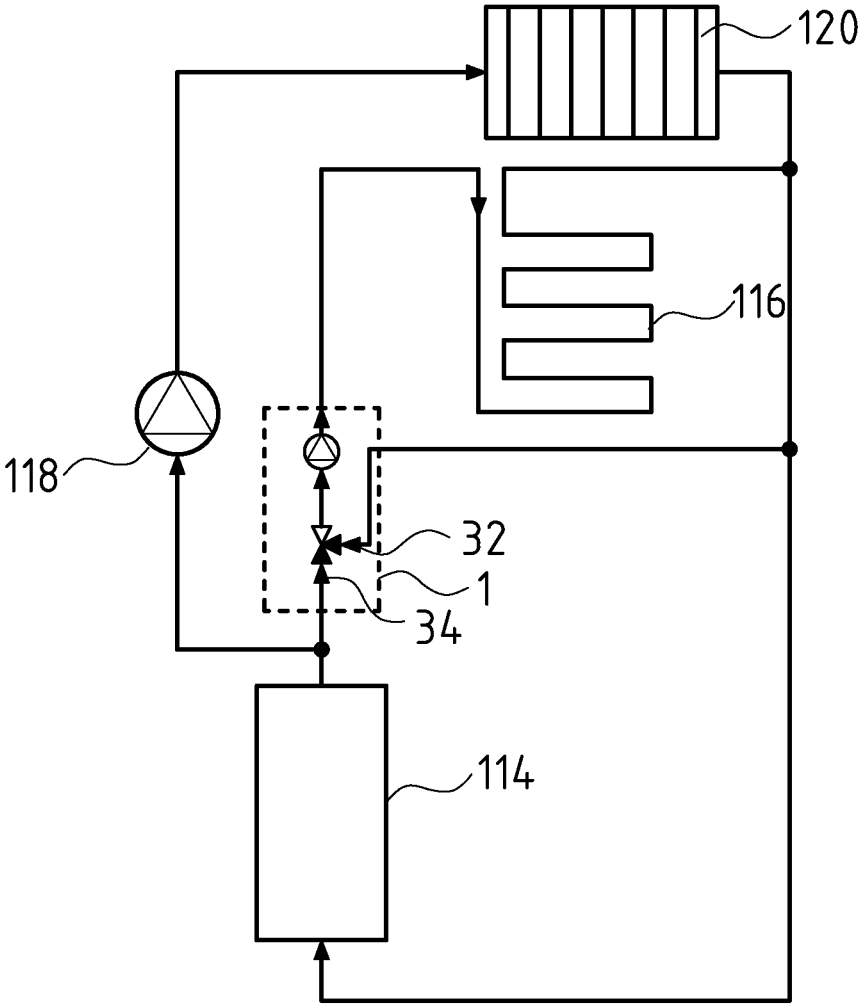
FIG. 37 is a schematic view showing the hydraulic construction of a heating facility with a centrifugal pump assembly according to FIGS. 29 to 36.
Figure 38:
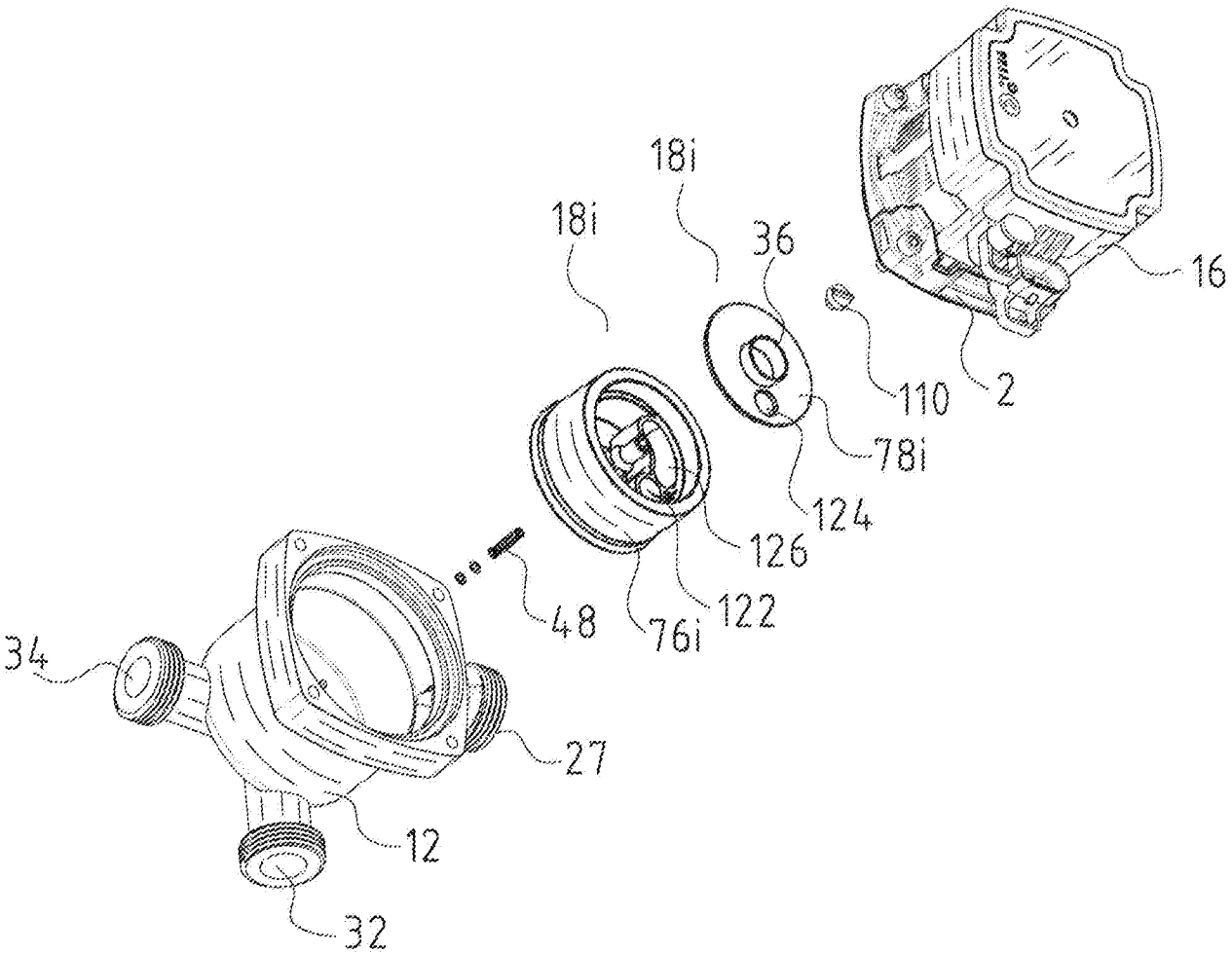
FIG. 38 is an exploded view of a centrifugal pump assembly according to a tenth embodiment of the invention.
Figure 39:
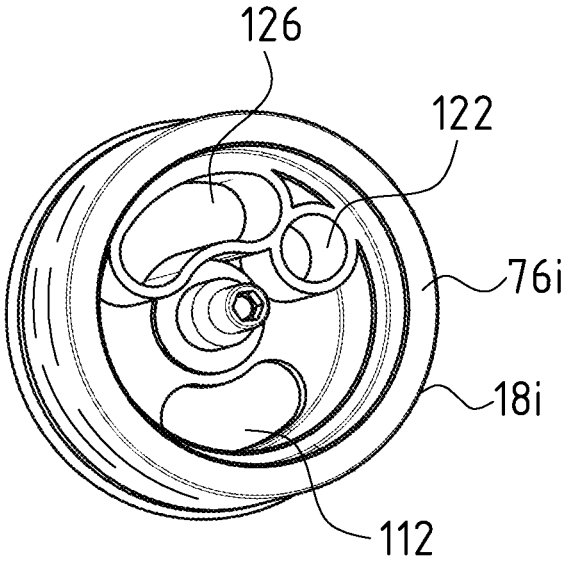
FIG. 39 is a perspective view of the opened valve element of the centrifugal pump assembly according to FIG. 38.
Figure 40:
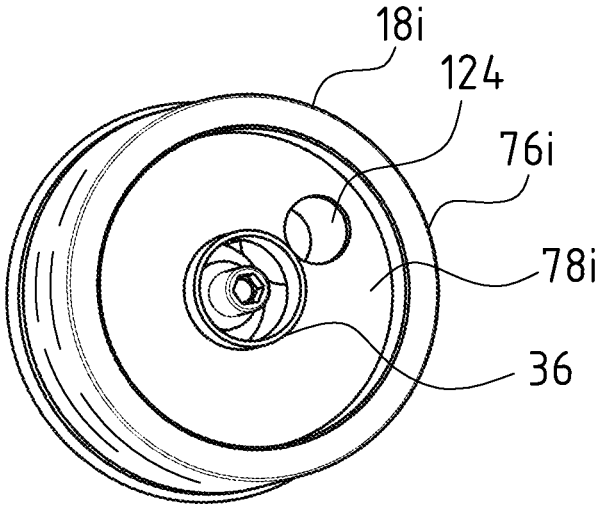
FIG. 40 is a perspective view of the closed valve element according to FIG. 39.
Figure 42:
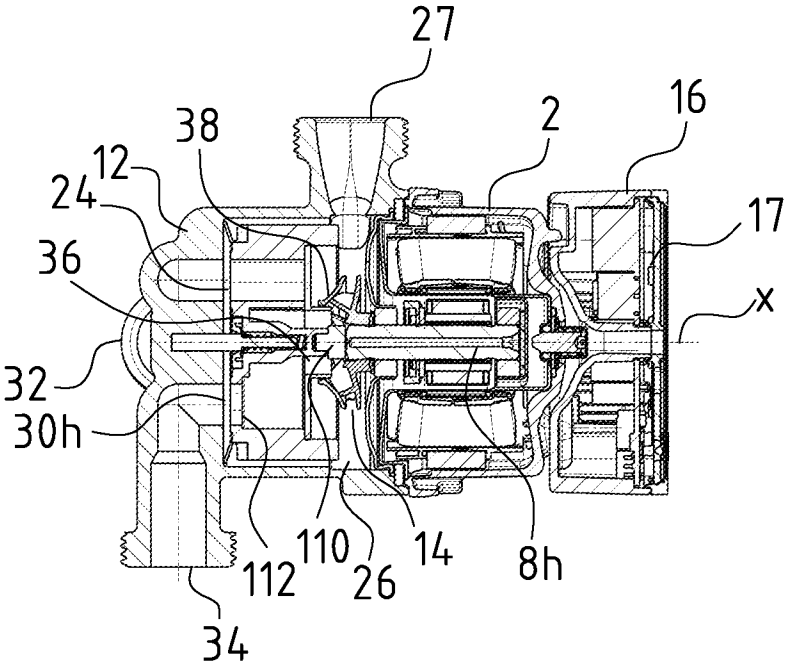
FIG. 42 is a sectional view according to FIG. 41 with the valve element in a second position.
Figure 41:
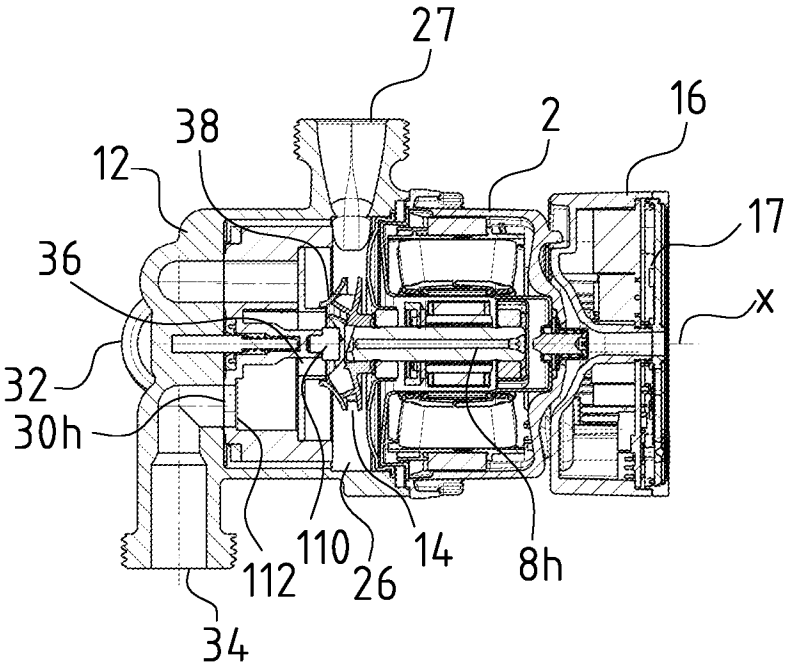
FIG. 41 is a sectional view of the centrifugal pump assembly according to FIG. 38 with the valve element in a first position.

Such a functionality can be applied for example in a hydraulic system as is shown in FIG. 37. There, the centrifugal pump assembly with the integrated valve as has been described above is characterized by the dashed line 1. The hydraulic circuit comprises a heat source 114 in the form of a gas heating boiler for example, the outlet of which running out for example into the suction branch 34 of the pump casing 12. In this example, a floor heating circuit 116 whose return is connected to the inlet of the heat source 114 as well as to the suction branch 32 of the centrifugal pump assembly 114 connects onto the delivery branch 27 of the centrifugal pump assembly 1. A further heating circuit 120 can be supplied with a heat transfer medium which has the outlet-side temperature of the heat source 114, via a second centrifugal pump assembly 118. The floor heating circuit 116 in contrast can be regulated in its feed temperature in a manner such that cold water from the return is admixed to the hot water at the outlet side of the heat source 114, wherein the mixing ratio can be changed by way of changing the opening ratios of the inlets 28*h* and 30*h* in the manner described above by way of rotating the valve element 18*h*.

The tenth embodiment example according to FIGS. 38 to 47 shows a centrifugal pump assembly which additionally to the previously described mixing function yet comprises a switch-over functionality for the additional supply of a secondary heat exchanger for the heating of service water.

Concerning this embodiment, the mounting and drive of the valve element 18*i* is effected just as with the ninth embodiment. In contrast to the valve element 18*h*, the valve element 18*i* additionally to the opening 112 comprises a through-channel 122 which extends from an opening 124 in the cover 78*i* to an opening in the base of the lower part 76*i* and therefore connects the two axial ends of the valve element 18*i* to one another. An arched bridging opening 126 is moreover yet formed in the valve element 18*i* and this opening is closed to the delivery chamber 28 by the cover 78*i* and is only open to the lower side, which is to say to the base of the lower part 76*i* and thus to the suction chamber 24.

Figure 44:
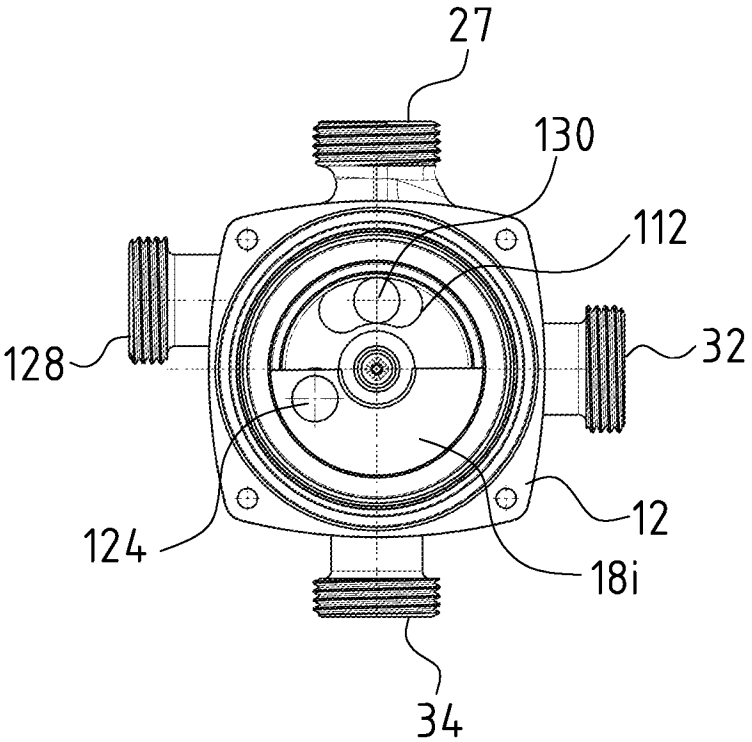
FIG. 44 is a plan view according to FIG. 43 with the valve element in a second switching position.
Figure 43:
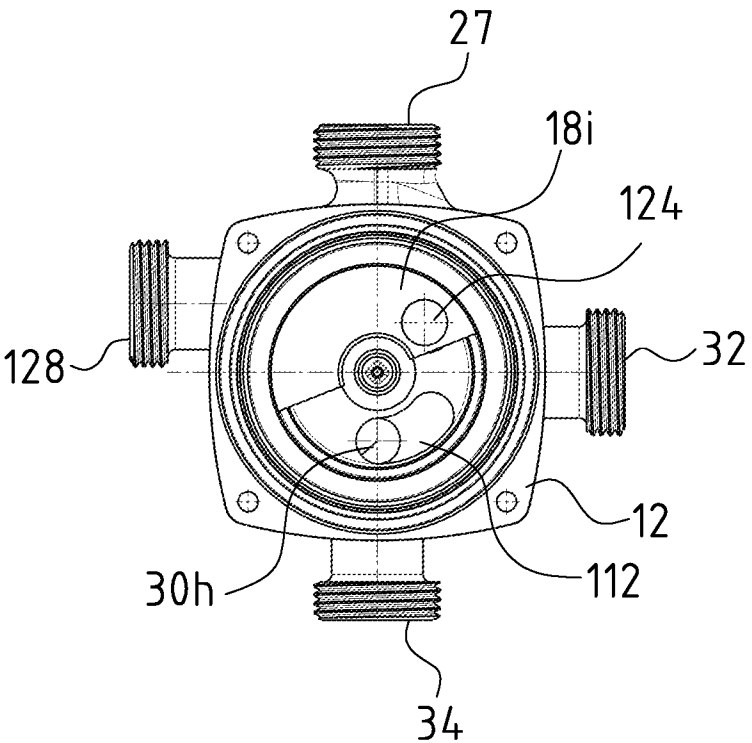
FIG. 43 is a plan view upon the opened pump casing of the centrifugal pump assembly according to FIGS. 38 to 42 with the valve element in a first switching position.
Figure 45:
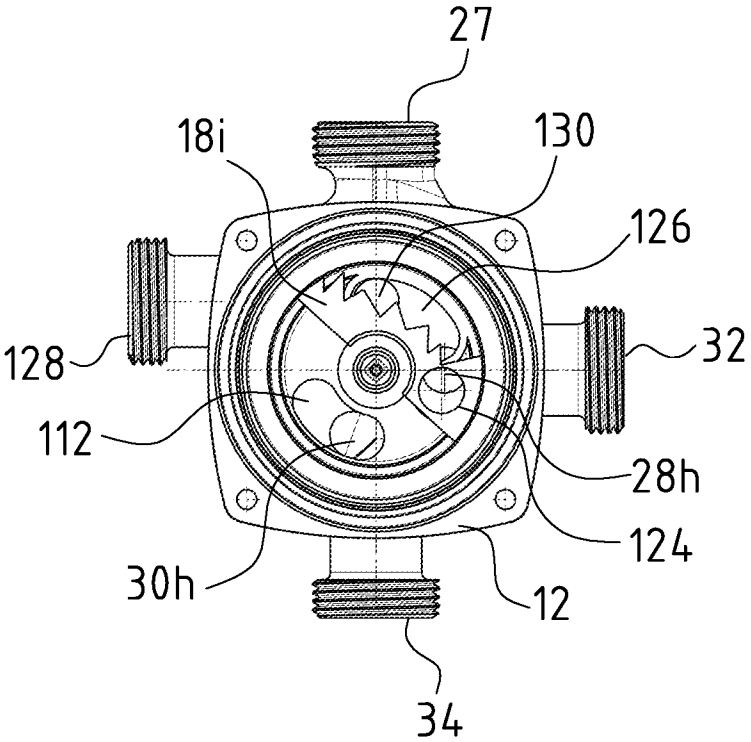
FIG. 45 is a plan view according to FIGS. 43 and 44 with the valve element in a third switching position.

Apart from the delivery branch 27 and both previously described suction branches 34 and 32, the pump casing 12 comprises a further branch 128. The branch 128 runs out in an inlet 130 in the base of the centrifugal pump assembly 12 additionally to the inlets 28*h* and 30*h*, into the suction chamber 24. The various switching positions are explained by way of FIGS. 43 to 46, wherein the cover 78*i* of the valve element 18*i* is shown in a partly opened manner in these figures, in order to clarify the position of the openings which lie therebelow. FIG. 43 shows a first switching position, in which the opening 112 lies opposite the inlet 30*h* so that a flow connection from the suction branch 34 to the suction port 38 of the impeller 14 is created. In the switching position according to FIG. 44, the opening 112 lies over the inlet 130, so that a flow connection from the branch 128 to the suction opening 36 and via this into the suction port 38 of the impeller 14 is created. In a further switching position which is shown in FIG. 45, the opening 112 lies over the inlet 30*h*, so that again a flow connection from the suction branch 34 to the suction port 38 of the impeller 14 is given. A partial overlapping of the opening 124 and of the through-hole 122 with the inlet 28*h* simultaneously takes place, so that a connection between the delivery chamber 26 and the suction port 32 which functions here as a delivery branch is created. The bridging opening 126 simultaneously overlaps the inlet 130 and a part of the inlet 28*h*, so that a connection from the branch 128 to the branch 32 is likewise created via the inlet 130, the bridging opening 126 and the inlet 28*h*.

Figure 46:
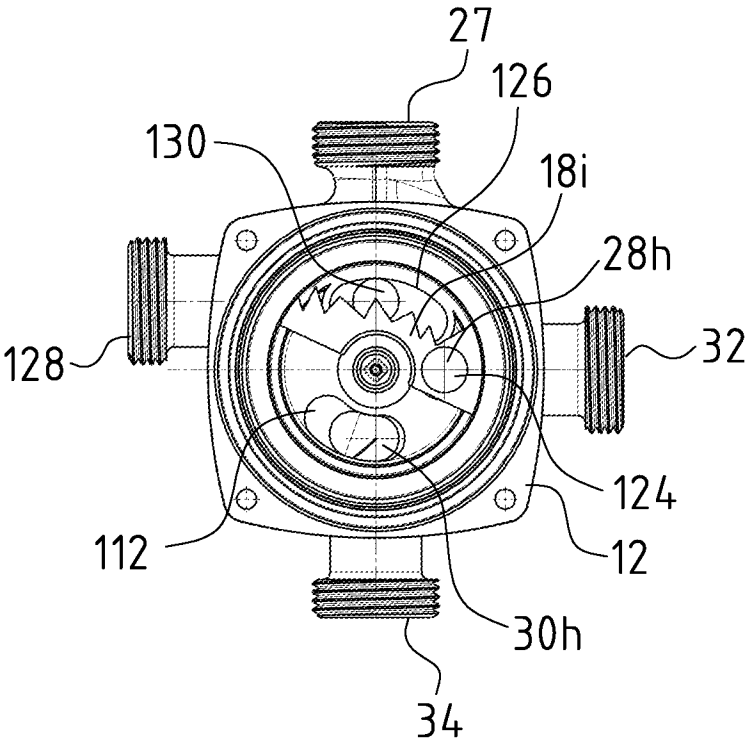
FIG. 46 is a plan view according to FIGS. 43 to 45 with the valve element in a fourth switching position.

FIG. 46 shows a fourth switching position, in which the through-channel 122 completely overlaps the inlet 28*h*, so that the branch 32 is connected to the delivery chamber 26 via the through-channel 122 and the opening 124. Simultaneously, the bridging opening 126 continues to cover only the inlet 130. The opening 112 continues to cover the inlet 30*h*.

Figure 47:
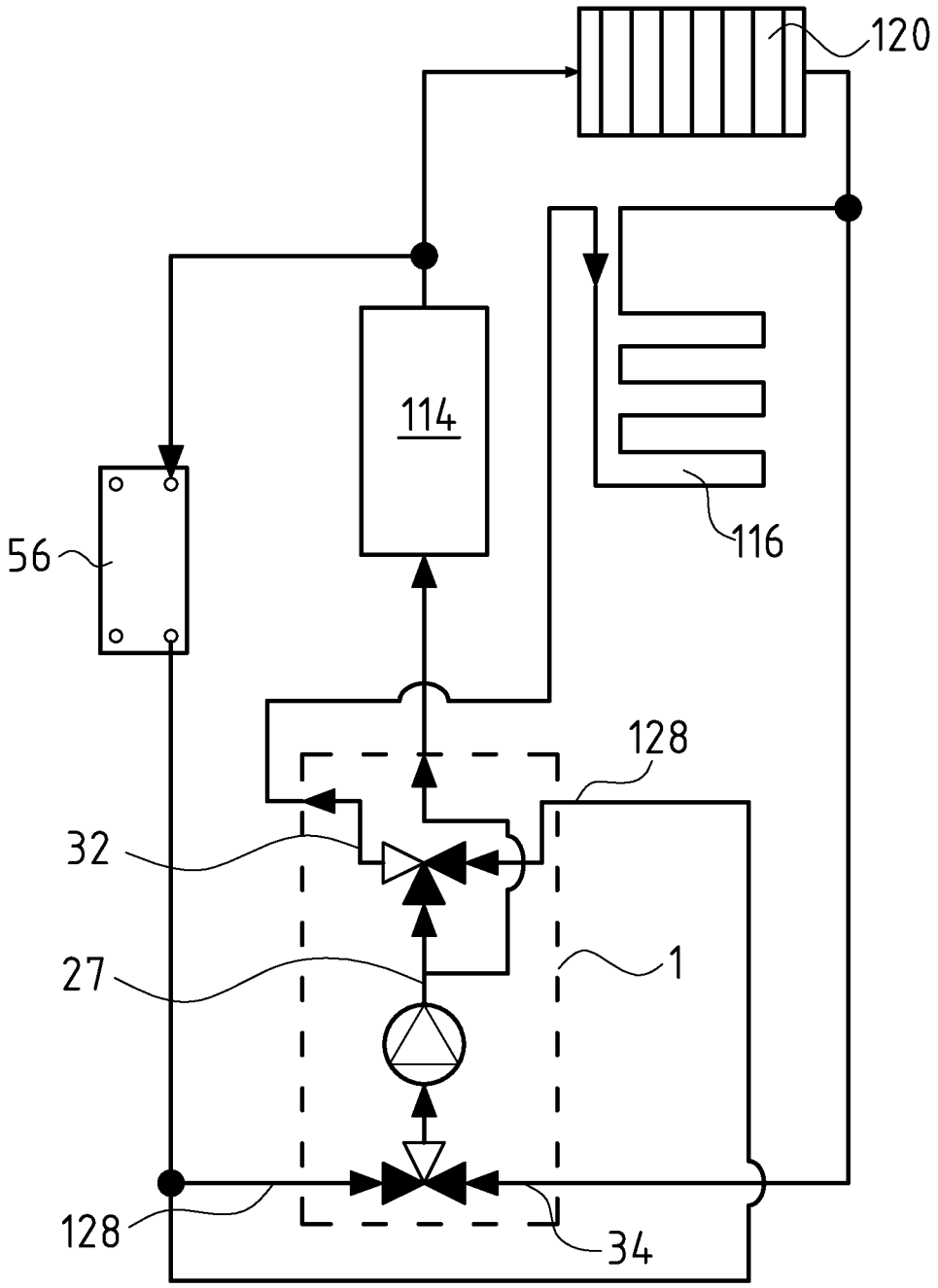
FIG. 47 is a schematic view showing the hydraulic construction of a heating facility with a centrifugal pump assembly according to FIGS. 38 to 46.

Such a centrifugal pump assembly can be applied for example in a heating system as is shown in FIG. 47. Here, the dashed line delimits the centrifugal pump assembly 1, as has just been described by way of FIGS. 38 to 46. The heating system again comprises a primary heat exchanger or a heat source 114 which for example can be gas heating boiler. At the outlet side, the flow path runs into a first heating circuit 120 which can be formed for example by way of conventional radiators. A flow path simultaneously branches to a secondary heat exchanger 56 for heating service water. The heating system moreover comprises a floor heating circuit 116. The returns of the heating circuit 120 and of the floor heating circuit 116 run out into the suction branch 34 on the pump casing 12. The return from the secondary heat exchanger 56 runs out into the branch 128 which provides two functionalities as is described hereinafter. The branch 32 of the pump casing 12 is connected to the feed of the floor heating circuit 116.

When the valve element 18*i* is located in the first switching position represented in FIG. 43, the impeller 14 delivers fluid from the suction branch 34 via the delivery branch 27 through the heat source 140 and the heating circuit 120 and back to the suction branch 34. If the valve element 18*i* is located in the second switching position which is shown in FIG. 44, the facility is switched over to service water operation and in this condition the pump assembly or the impeller 14 delivers fluid from the branch 128 which serves as a suction branch, through the delivery branch 27, via the heat source 114 through the secondary heat exchanger 56 and back to the branch 128. The floor heating circuit 116 is additionally supplied if the valve element 18*i* is located in the third switching position which is shown in FIG. 45. The water flows into the suction port 38 of the impeller 14 via the suction branch 34 and is delivered via the delivery branch 27 through the first heating circuit 120 via the heat source 114 in the described manner. The fluid at the outlet side of the impeller 14 simultaneously exits the delivery chamber 26 into the opening 124 and through the through-channel 122 and thus flows to the branch 32 and via this into the floor heating circuit 116.

Fluid simultaneously flows via the bridging opening 126 into the branch 32 via the branch 128 and the inlet 130, in the switching position which is shown in FIG. 45. This means that here water flows via the heat source 114 through the secondary heat exchanger 26 and the branch 128 to the branch 32. Since essentially no heat is taken at the secondary heat exchanger 56 in this heating operation, hot water is admixed to the branch 32 additionally to the cold water which flows out of the delivery chamber 26 to the branch 32 via the through-channel 130. The quantity of the admixed warm water at the branch 32 can be varied by way of changing the degree of opening via the valve position 18*i*. FIG. 46 shows a switching position, in which the admixing is switched off and the branch 32 is exclusively in direct connection with the delivery chamber 26. In this condition, the water in the floor heating circuit 116 is delivered in the circuit without any supply of heat. It is to be recognized that with this embodiment, a switching between the heating and service water heating as well as simultaneously the supply of heating circuits with two different temperatures, specifically of a first heating circuit 120 with the exit temperature of the heat source 114 and of a floor heating circuit 116 with a temperature which is reduced via a mixing function, can also be achieved by way of the change of the switching positions of the valve element 18*i*.

It is to be understood that the various previously described embodiments can be combined with one another in a different manner. Thus the different described drive modes of the valve element can be essentially arbitrarily combined with different geometric configurations of the valve element as have likewise been described above. The different valve functionalities (for example mixing and switching-over) can likewise be realized and combined with different drive modes. These different combination possibilities which are to be derived from the preceding embodiment examples are expressly encompassed by the invention. In all shown embodiments, the valve element is arranged directly in the pump casing, which is to say that the pump casing forms a combined pump and valve casing. However, it is to be understood that the pump casing could also be configured in a multi-part manner. In particular, the valve element could also be arranged in a casing which is separate from the pump casing and which is connected to the pump casing, in which the impeller rotates, only via suitable connection channels or pipe conduits.

While specific embodiments of the invention have been shown and described in detail to illustrate the application of the principles of the invention, it will be understood that the invention may be embodied otherwise without departing from such principles.

The invention claimed is:

1. A centrifugal pump assembly comprising:

an electrical drive motor;

an impeller which is driven by the electrical drive motor; and at least one valve element which is directly or indirectly movable along a first movement path between at least two switching positions by the electrical drive motor, the valve element being configured to adjust a flow of fluid from at least one inlet when the valve element is in one of the at least two switching positions, the valve element being further configured to adjust the flow of fluid from the inlet when the valve element is in another one of the at least two switching positions, wherein the flow of fluid from the inlet when the valve element is in the first switching position is different from the flow of fluid from the inlet when the valve element is in the second switching position, wherein at least a part of the valve element is additionally movable along a second movement path, which is different from the first movement path, between a released position, in which the valve element is distanced to at least one contact surface and a bearing position, in which the valve element bears on the at least one contact surface, wherein the at least one contact surface is a sealing surface configured to contact the valve element when the valve element is in the bearing position, wherein the at least one valve element is movable along the first movement path by way of a flow which is produced by the impeller and is movable along the second movement path by way of a fluid pressure which is produced by the impeller, and the drive motor comprises a control device which is configured such that the drive motor can be started up with a first acceleration course, at which the pressure builds up more rapidly than the flow, and with a second acceleration course, at which the flow builds up more rapidly than the pressure.

2. A centrifugal pump assembly comprising:

an electrical drive motor;

an impeller which is driven by the electrical drive motor; and at least one valve element which is directly or indirectly movable along a first movement path between at least two switching positions by the electrical drive motor, the valve element being configured to adjust a flow of fluid from at least one inlet when the valve element is in one of the at least two switching positions, the valve element being further configured to adjust the flow of fluid from the inlet when the valve element is in another one of the at least two switching positions, wherein the flow of fluid from the inlet when the valve element is in the first switching position is different from the flow of fluid from the inlet when the valve element is in the second switching position, wherein at least a part of the valve element is additionally movable along a second movement path, which is different from the first movement path, between a released position, in which the valve element is distanced to at least one contact surface and a bearing position, in which the valve element bears on the at least one contact surface, wherein the at least one contact surface is a sealing surface configured to contact the valve element when the valve element is in the bearing position, wherein for a valve element movement along the first movement path, the at least one valve element is coupled to the impeller or to a shaft of the drive motor which drives the impeller, via a releasable coupling which is releasable in a pressure-dependent and/or speed-dependent and/or rotation-direction-dependent manner.

3. A centrifugal pump assembly comprising:

an electrical drive motor;

an impeller which is driven by the electrical drive motor; and at least one valve element which is directly or indirectly movable along a first movement path between at least two switching positions by the electrical drive motor, the valve element being configured to adjust a flow of fluid from at least one inlet when the valve element is in one of the at least two switching positions, the valve element being further configured to adjust the flow of fluid from the inlet when the valve element is in another one of the at least two switching positions, wherein the flow of fluid from the inlet when the valve element is in the first switching position is different from the flow of fluid from the inlet when the valve element is in the second switching position, wherein at least a part of the valve element is additionally movable along a second movement path, which is different from the first movement path, between a released position, in which the valve element is distanced to at least one contact surface and a bearing position, in which the valve element bears on the at least one contact surface, wherein the at least one contact surface is a sealing surface configured to contact the valve element when the valve element is in the bearing position, wherein the at least one valve element is configured and arranged such that in a pump casing which surrounds the impeller, the at least one valve element separates a suction chamber which is in connection with a suction side of the impeller, from a delivery chamber which is in connection with a delivery side of the impeller.

4. A centrifugal pump assembly comprising:

an electrical drive motor;

an impeller which is driven by the electrical drive motor; and at least one valve element which is directly or indirectly movable along a first movement path between at least two switching positions by the electrical drive motor, the valve element being configured to adjust a flow of fluid from at least one inlet when the valve element is in one of the at least two switching positions, the valve element being further configured to adjust the flow of fluid from the inlet when the valve element is in another one of the at least two switching positions, wherein the flow of fluid from the inlet when the valve element is in the first switching position is different from the flow of fluid from the inlet when the valve element is in the second switching position, wherein at least a part of the valve element is additionally movable along a second movement path, which is different from the first movement path, between a released position, in which the valve element is distanced to at least one contact surface and a bearing position, in which the valve element bears on the at least one contact surface, wherein the at least one contact surface is a sealing surface configured to contact the valve element when the valve element is in the bearing position, wherein the at least one valve element is configured and arranged such that in a pump casing which surrounds the impeller the at least one valve element separates a suction chamber which is in connection with a suction side of the impeller, from a delivery chamber which is in connection with a delivery side of the impeller, wherein in the delivery chamber, a flow which is produced by the impeller acts upon the valve element for valve element movement along the first movement path, and the suction chamber is designed such that the flow which prevails there exerts no force upon the valve element in the direction of the first movement path.

* * * * *